US006941914B2

(12) United States Patent
Snyder et al.

(10) Patent No.: US 6,941,914 B2
(45) Date of Patent: Sep. 13, 2005

(54) INTERNAL COMBUSTION ENGINE

(75) Inventors: Dale D. Snyder, Neenah, WI (US); Thomas A. Immel, Malone, WI (US); Scot A. Koehler, Appleton, WI (US); Gary Stanelle, Fond du Lac, WI (US); Karl W. Monis, Oconomowoc, WI (US); Mark J. Glodowski, DePere, WI (US); Russell J. Dopke, Elkhart Lake, WI (US)

(73) Assignee: Tecumseh Products Company, Tecumseh, MI (US)

( * ) Notice: Subject to any disclaimer, the term of this patent is extended or adjusted under 35 U.S.C. 154(b) by 39 days.

(21) Appl. No.: 10/409,262

(22) Filed: Apr. 8, 2003

(65) Prior Publication Data

US 2004/0025823 A1 Feb. 12, 2004

Related U.S. Application Data

(60) Provisional application No. 60/402,841, filed on Aug. 12, 2002, and provisional application No. 60/372,560, filed on Apr. 15, 2002.

(51) Int. Cl.[7] ..... F01L 1/02

(52) U.S. Cl. ..... 123/90.31; 123/90.27; 123/193.1; 123/193.5; 123/195 AC; 123/195 HC; 29/888.01; 29/888.06

(58) Field of Search ..... 123/90.31, 90.27, 123/90.22, 90.23, 53.3–53.6, 54.4, 55.2–55.7, 658, 193.1–193.6, 195 AC, 195 HC, DIG. 5–DIG. 8; 29/888.01, 888.06

(56) References Cited

U.S. PATENT DOCUMENTS 872,571 A 12/1907 Moser
1,155,044 A 9/1915 Cobb
1,874,195 A 8/1932 King (Continued)

FOREIGN PATENT DOCUMENTS

| | | |
|---|---|---|
| DE | 944 640 | 6/1956 |
| EP | 1 092 852 | 4/2001 |
| FR | 2 629 865 | 4/1988 |
| GB | 2344378 A | 6/2000 |
| JP | 02-042139 | 2/1990 |
| JP | 53-35813 | 12/1993 |
| JP | 2001-1263028 | 3/2000 |
| WO | WO 81/02040 | 7/1981 |
| WO | WO 02/25082 A2 | 3/2002 |
| WO | WO 03/018975 A1 | 3/2003 |

OTHER PUBLICATIONS

European Search Report regarding EP 04 00 7931.

*Primary Examiner*—Thomas Denion
*Assistant Examiner*—Kyle M. Riddle
(74) *Attorney, Agent, or Firm*—Baker & Daniels

(57) ABSTRACT

A twin cylinder engine, includes a pair of cylinder members mounted to mounting surfaces of a crankcase, and cylinder heads mounted to the cylinder members. The cylinder members are modular components, which may be pre-assembled with components of the valve train as packaged units before the cylinder members are attached to the crankcase. Each cylinder member rotatably supports a cam gear which extends into the crankcase for driving engagement with the crankshaft. The cylinder members may be configured for either side valve-type ("L-head"), or overhead valve-type ("OHV") engines, and the cylinder members may also be used in single cylinder engines.

23 Claims, 28 Drawing Sheets

U.S. PATENT DOCUMENTS 2,041,979 A 5/1936 Thege ..... 121/94
2,218,332 A 10/1940 Fowler ..... 123/195
2,491,630 A 12/1949 Voorhies ..... 121/194
2,671,436 A 3/1954 Pitt et al. ..... 123/55
3,561,416 A 2/1971 Kiekhaefer ..... 123/193
4,129,103 A 12/1978 Pichl ..... 123/52 R
4,134,370 A 1/1979 Iwahashi et al. ..... 123/41.31
4,135,478 A 1/1979 Rassey ..... 123/59 R
4,156,409 A 5/1979 Nakano ..... 123/41.65
4,198,947 A 4/1980 Rassey ..... 123/55 R
4,380,216 A 4/1983 Kandler ..... 123/90.65
4,658,767 A 4/1987 Fujikawa et al. ..... 123/52 MV
4,662,322 A 5/1987 Tamba et al. ..... 123/41.86
4,681,067 A 7/1987 Tamba et al. ..... 123/41.1
4,697,557 A 10/1987 Tamba et al. ..... 123/319
4,714,060 A 12/1987 Kesteloot ..... 123/195 R
4,756,280 A 7/1988 Tamba et al. ..... 123/41.47
4,862,981 A 9/1989 Fujikawa et al. ..... 180/68.4
4,870,928 A 10/1989 Miyake et al. ..... 123/52 MV
4,873,945 A 10/1989 Tamba et al. ..... 123/55 R
D308,871 S 6/1990 Harkness et al. ..... D15/1
D308,872 S 6/1990 Harkness et al. ..... D15/1
4,930,476 A 6/1990 Oguri et al. ..... 123/376
4,934,342 A 6/1990 Tamba et al. ..... 123/52 MV
4,936,263 A 6/1990 Tamba et al. ..... 123/55 VF
4,957,078 A 9/1990 Ohkawa et al. ..... 123/90.31
5,235,942 A 8/1993 Olmr ..... 123/90.27
D343,843 S 2/1994 Mikado ..... D15/1
5,341,781 A 8/1994 Gerhardt ..... 123/195 R
5,647,337 A 7/1997 Johnson et al. ..... 123/572
5,813,384 A 9/1998 Lavender et al. ..... 123/198 E
5,823,156 A 10/1998 Thiel et al. ..... 123/184.31
5,887,678 A 3/1999 Lavender ..... 184/11.2
5,950,579 A 9/1999 Ott ..... 123/54.4
5,992,393 A 11/1999 Yoshida et al. ..... 123/509
D421,024 S 2/2000 Katoh ..... D15/1
6,105,548 A 8/2000 Carlson et al. ..... 123/195 A
6,109,221 A 8/2000 Higgins et al. ..... 123/41.47
6,145,479 A 11/2000 Rotter ..... 123/41.49
6,178,932 B1 1/2001 Matsuda et al. ..... 123/54.4
6,213,072 B1 * 4/2001 Sayama et al. ..... 123/90.31
D443,280 S 6/2001 Shimizu ..... D15/1
6,343,576 B1 2/2002 Ogata et al. ..... 123/54.4
6,354,249 B1 3/2002 Gerhardt ..... 123/25 A
6,357,401 B1 3/2002 Moriyama et al. ..... 123/54.4
6,595,167 B2 * 7/2003 Kaesgen ..... 123/55.2
2001/0013327 A1 8/2001 Ryu et al. ..... 123/196 R
2001/0047788 A1 12/2001 Ito et al. ..... 123/196 R
2002/0023596 A1 2/2002 Hirano et al. ..... 123/41.1
2002/0023731 A1 2/2002 Hirano et al. ..... 165/51

* cited by examiner

INTERNAL COMBUSTION ENGINE

CROSS REFERENCE TO RELATED APPLICATIONS

This application claims the benefit under Title 35, U.S.C. § 119(e) of U.S. Provisional Patent Application Ser. No. 60/372,560, entitled INTERNAL COMBUSTION ENGINE, filed on Apr. 15, 2002, and U.S. Provisional Patent Application Ser. No. 60/402,841, entitled INTERNAL COMBUSTION ENGINE, filed on Aug. 12, 2002.

BACKGROUND OF THE INVENTION

1. Field of the Invention

The present invention relates to small internal combustion engines, which are used in a variety of applications, such as lawnmowers, lawn and garden tractors, other small working implements such as snow throwers and generators, or in sport vehicles.

2. Description of the Related Art

Small internal combustion engines typically include one or two engine cylinders. Single cylinder engines generally have a valve train of the side valve ("L-head"), overhead cam ("OHC") or overhead valve ("OHV") type, and are typically contained within a pair of castings. A first casting may include, for example, the engine cylinder, a portion of the crankcase, and optionally a cylinder head integrally formed with the engine cylinder. A second casting may include a crankcase cover which is attached to the crankcase portion of the first casting to define the enclosed crankcase of the engine. The crankshaft may be disposed in either a horizontal or a vertical orientation, and may be journalled in full bearings, one defined in each crankcase casting, or alternatively, in split bearings, wherein each crankcase casting defines one-half of each of the crankshaft bearings.

Twin cylinder engines generally have valve trains of the overhead cam ("OHC") or overhead valve ("OHV") type, and are typically contained within a first casting which includes the engine cylinders and a portion of the crankcase. A second casting typically includes a crankcase cover which is attached to the crankcase portion of the first casting to define the enclosed crankcase of the engine. The crankshaft may be disposed in either a horizontal or a vertical orientation, and may be journalled in full bearings, one defined in each crankcase casting, or alternatively, in split bearings, wherein each crankcase casting defines one-half of each of the crankshaft bearings.

A disadvantage with existing engine designs is that the castings or housing portions which contain the single and twin cylinder engines have a specific construction which is unique to each of the single and twin cylinder engines. Therefore, interchangeability of castings or other housing components between single and twin cylinder engines is not possible.

Further, in OHC engines, a camshaft located within the cylinder head of the engine is typically driven with a belt connecting a drive pulley on the crankshaft with a driven pulley on the camshaft. In these engines, assembling the belt to the drive and the driven pulleys can be difficult during the manufacturing process.

What is needed is a small internal combustion engine which is an improvement over the foregoing.

SUMMARY OF THE INVENTION

The present invention provides a line of internal combustion engines, including twin cylinder engines and single cylinder engines. The crankshafts of each of the engines may be disposed in either a horizontal orientation or a in vertical orientation to suit the particular application in which the engines are used. The engines each include a crankcase, and at least one cylinder member mounted to the crankcase, wherein each cylinder member is a component separate from the crankcase. In the V-twin engines disclosed herein, the crankcase includes a pair of cylinder members mounted to mounting surfaces of the crankcase at an angle with respect to one another to define a V-space therebetween, and a pair of cylinder heads mounted to the cylinder members. Alternatively, the cylinder members may each include integral cylinder heads. In the single cylinder engines disclosed herein, the crankcase includes a single mounting surface to which a single cylinder member is attached.

The cylinder members are modular components, to, which components of the valve train may be pre-assembled before the cylinder members are attached to the crankcase, thereby facilitating easier final assembly of the engines. In addition, the same cylinder members may be used in both twin cylinder engines and in single cylinder engines.

In one embodiment, the engine valve train is configured as a side valve or "L-head" type valve train, in which intake and exhaust valves are carried each cylinder member. A cylinder head is attached to each cylinder member, with each cylinder member and cylinder head defining a combustion chamber therebetween.

In another embodiment, the engine valve train is configured as an overhead valve ("OHV") valve train, in which push rods are carried in each cylinder member for actuating rocker arms and intake and exhaust valves which are mounted in the cylinder head.

In the twin cylinder engines, the cylinder members may be mounted to the crankcase in a manner in which the cylinder members are disposed at an angle, such as a 90° angle, with respect to one another to thereby define a V-space therebetween. The cylinder members each include a cam gear and cam lobe assembly and, when the cylinder members are attached to the crankcase, at least a portion of the cam gears of the cam gear and lobe assemblies extend into the crankcase for driving engagement with a drive gear mounted on the crankshaft. Alternatively, the cylinder members may be mounted to opposite sides of the crankcase to provide a twin cylinder opposed engine.

In the twin cylinder engines, one cam gear and lobe assembly is disposed in a first orientation, and the other cam gear and lobe assembly is disposed in an orientation which is rotated 180° with respect to the orientation of the first cam gear and lobe assembly. In this manner, the lobe(s) of the first cam gear and lobe assembly face in a first direction, and the lobe(s) of the second cam gear and lobe assembly face in an opposite direction. With the foregoing construction, space in the crankcase is conserved, and the cam gears may each be driven from a single, relatively thinly profiled drive gear which is mounted to the crankshaft. Additionally, the foregoing construction conserves space within the crankcase by compensating for the "stagger area" which is necessitated in V-twin engines by the connecting rods of the two cylinders positioned adjacent to one another on the crank pin of the crankshaft.

The cam lobe(s) of each of the cam gear and lobe assemblies respectively actuate a pair of lifters pivotally mounted in each of the cylinder members. When the cylinder members are configured for a side valve or "L-head" engine, the cylinder members include intake and exhaust valves which are directly actuated by the lifters. When the cylinder members are configured for an OHV engine, the cylinder members include push rods which are actuated by the lifters, the push rods in turn actuating a valve assembly in the cylinder head, which includes rocker arms and intake and exhaust valves.

Further, the cylinder members may also be used in single cylinder engines to form side valve or "L-head" horizontal or vertical crankshaft engines, or OHV horizontal or vertical crankshaft engines. In this manner, the cylinder members are modular components which may be used in either twin cylinder engines or in single cylinder engines, thereby reducing the number of total components which are needed to produce a line of V-twin and single cylinder engines as well as the costs associated with manufacturing single and twin cylinder engines.

In particular, the cylinder members which are configured for a side valve or "L-head" valve train and the cylinder members which are configured for an OHV valve train each include identical cam gear and lobe assemblies and identical lifter assemblies. In each configuration, the cam gears extend at least partially into the crankcase for driving engagement with a drive gear mounted to the crankshaft. Thus, the valve train for each of the foregoing configurations is identical between the crankshaft and the lifters, permitting the two types of cylinder members to be assembled to a crankcase in the same manner, and permitting the same crankcase to be used with either type of cylinder member.

In one form thereof, the present invention provides a twin cylinder internal combustion engine, including a crankcase; a crankshaft rotatably disposed within the crankcase, the crankshaft having a drive gear mounted thereto; a pair of cylinder members mounted to the crankcase, the cylinder members and the crankcase being separate components; and a valve train, including a pair of cam gears supported respectively by the cylinder members, the cam gears in meshing engagement with the drive gear; at least one cam lobe associated with each the cam gear; and at least one lifter pivotally mounted within each the cylinder member, each the lifter in engagement with a respective the cam lobe.

In another form thereof, the present invention provides a twin cylinder internal combustion engine, including a crankcase having a crankshaft rotatably disposed therein; a pair of cylinder members mounted to the crankcase, the cylinder members and the crankcase being separate components; and a valve train, including a pair of cam gears rotatably supported respectively by the cylinder members, at least a portion of each the cam gear extending into the crankcase for driving engagement with the crankshaft; a pair of cam lobes associated with each the cam gear; and a pair of lifters pivotally mounted to each the cylinder member, each the lifter in engagement with a respective the cam lobe.

In a further form thereof, the present invention provides a method of assembling an internal combustion engine having a crankcase, including the steps of providing a cylinder member; assembling valve train components to the cylinder member, the valve train components including a cam gear, at least one cam lobe, and at least one lifter; and then securing the cylinder member to the crankcase.

In another form thereof, the present invention provides a twin cylinder internal combustion engine, including a crankcase; a pair of cylinder members mounted to the crankcase, the cylinder members and the crankcase being separate components; a cam gear and lobe assembly rotatably carried by each the cylinder member, one of the cam gear and lobe assemblies facing in a first direction, and the other of the cam gear and lobe assemblies facing in a second direction opposite the first direction.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION

Figure 14:
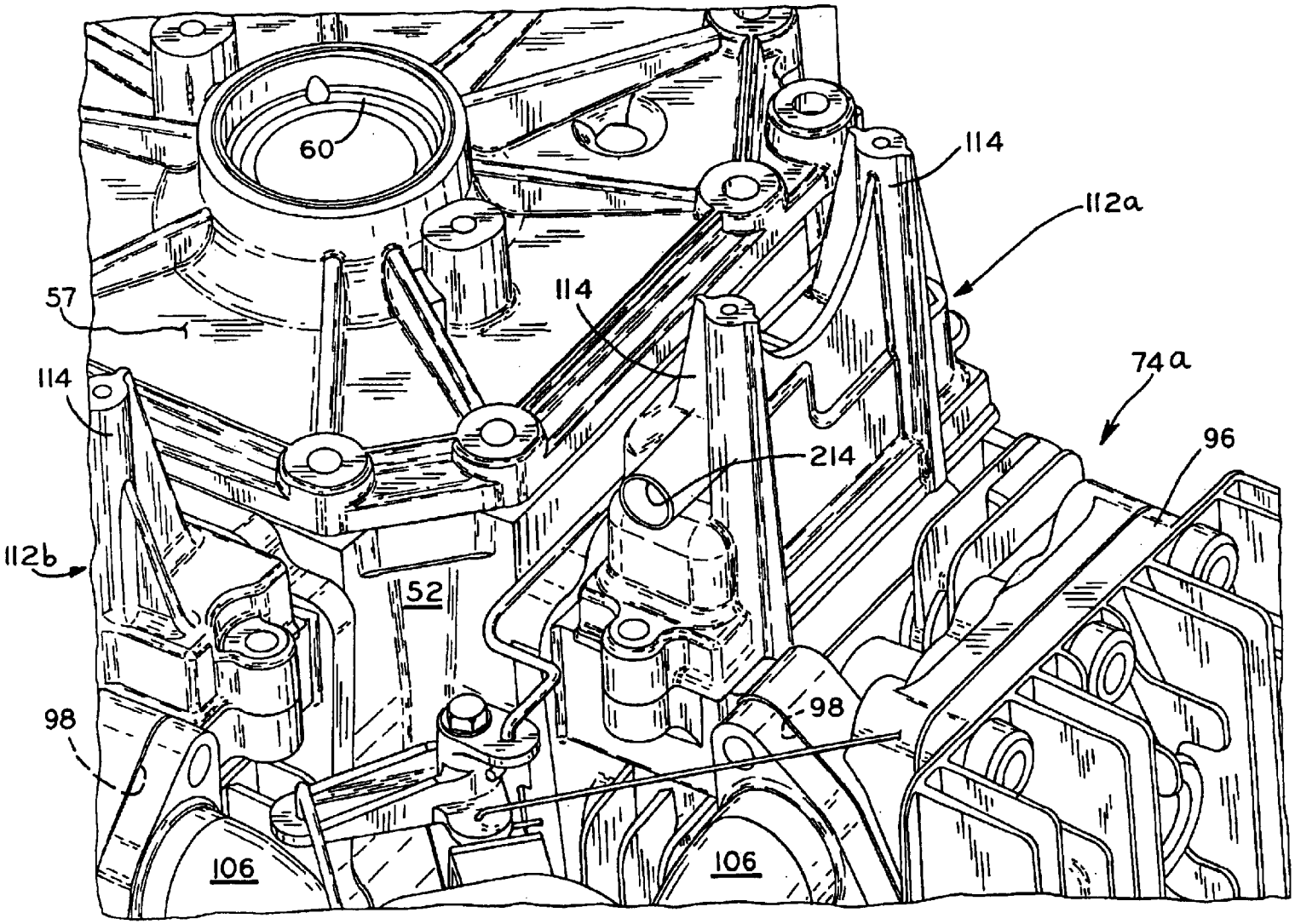
FIG. 14 is a partial perspective view of the engine of FIGS. 1–7 in a vertical crankshaft orientation, showing a breather cover attached to a cylinder member, the cylinder cover including a breather hose fitting and ignition module supports.

Referring to FIGS. 1–7, a first internal combustion engine 50 is shown as a horizontal crankshaft, V-twin engine having a side valve or "L-head" valve train, as discussed in detail below. However, engine 50 may, with minor modifications, also be configured as a vertical crankshaft, V-twin engine having a side valve or "L-head" valve train, as shown in FIG. 14. Also described below is engine 300, shown in FIGS. 15–24 which is similar to engine 50, and which may be configured as a horizontal or vertical crankshaft V-twin engine having an overhead valve ("OHV") valve train. Further, the cylinder members of engines 50 or 300 may also be used in a twin cylinder opposed engine such as engine 400 shown in FIG. 25. Still further, a cylinder member of engines 50 or 300 may be used in a vertical or a horizontal crankshaft single cylinder engine, such as engines 500, 600, and shown in FIGS. 26, 27, and 28, respectively.

Figure 1:
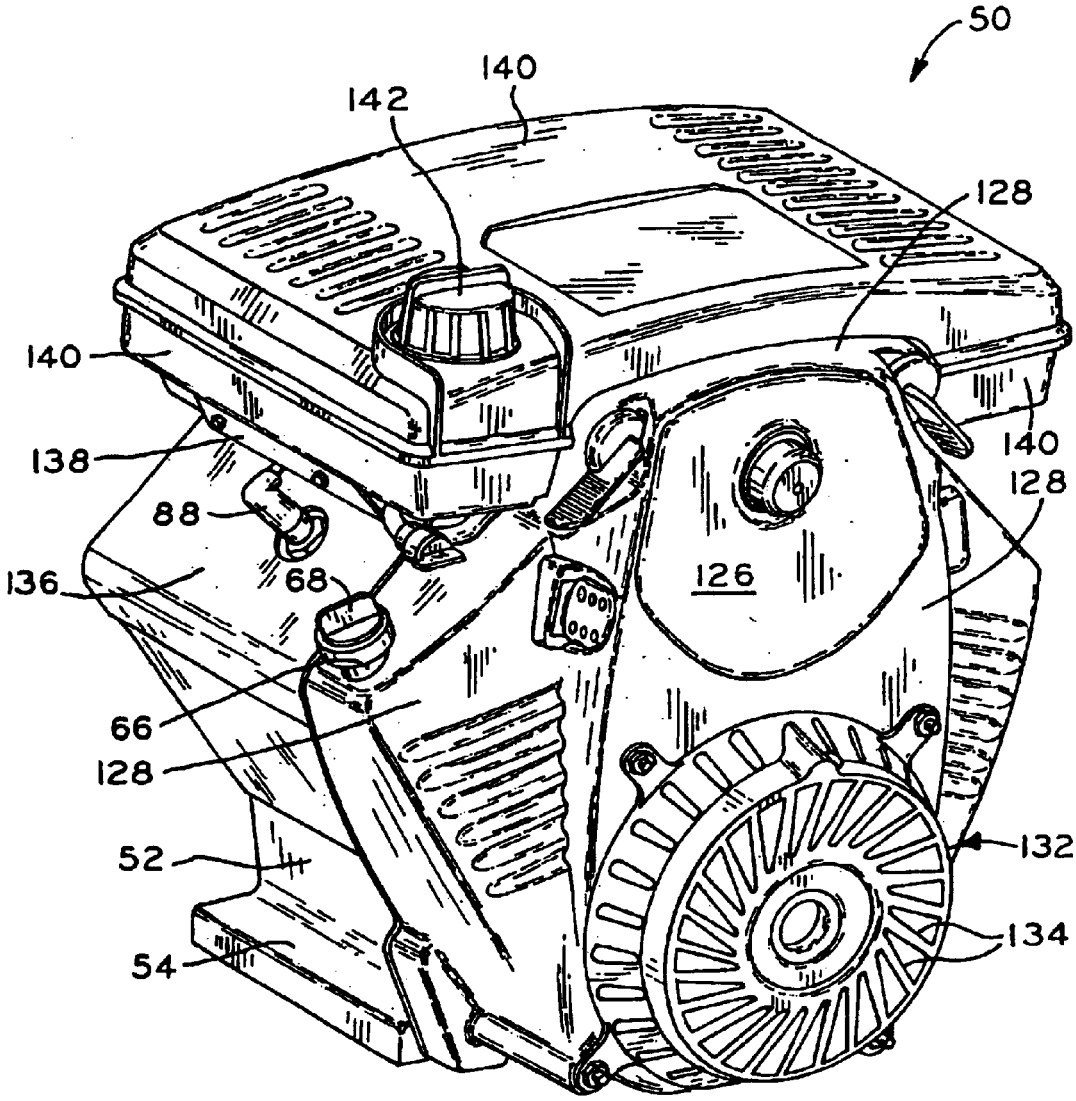
FIG. 1 is a front perspective view of a horizontal crankshaft, V-twin engine according to the present invention, the engine having a side valve or "L-head" valve train.
Figure 2:
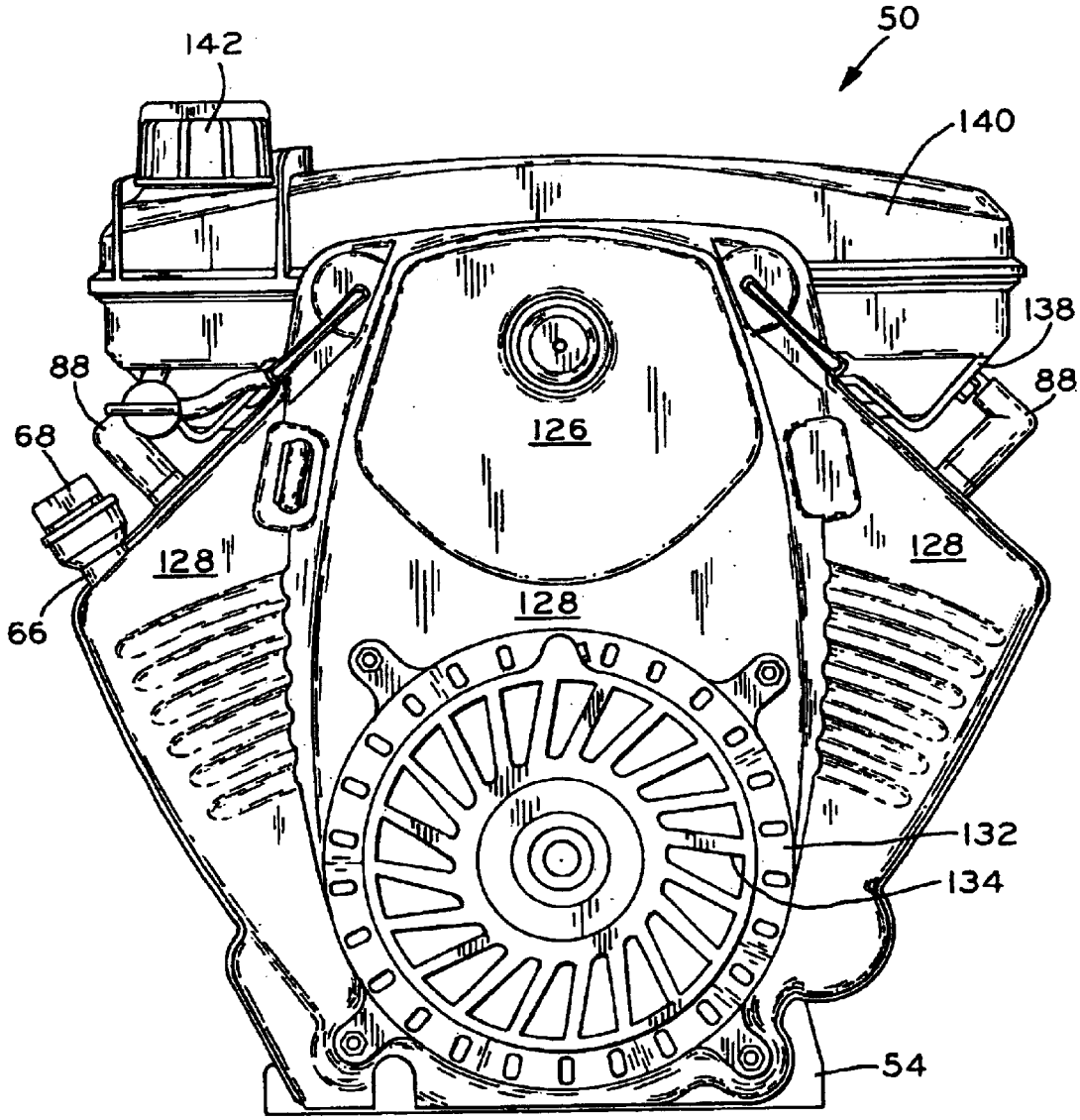
FIG. 2 is a front view of the engine of FIG. 1.
Figure 3:
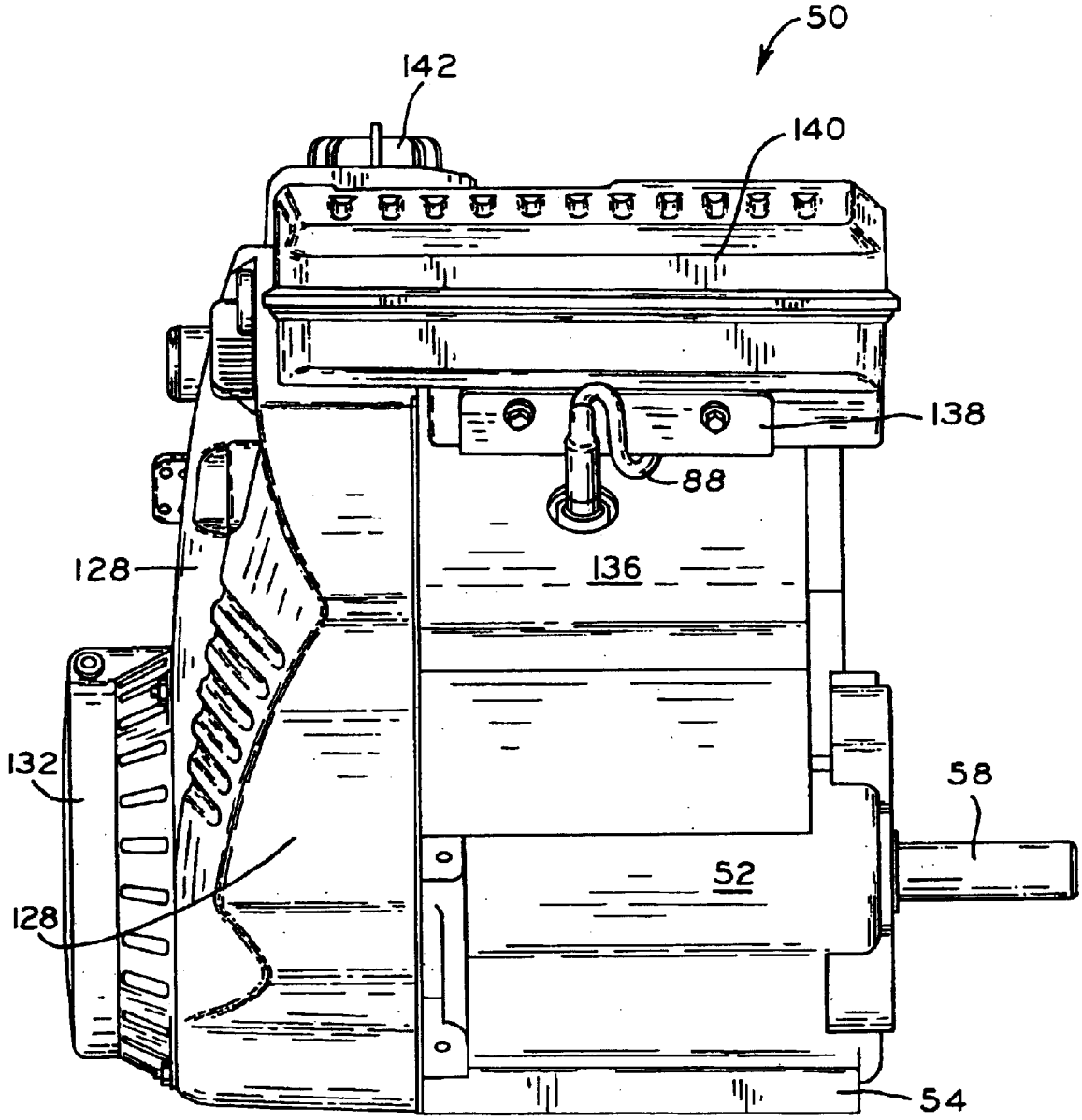
FIG. 3 is a right side view of the engine of FIG. 1.
Figure 4:
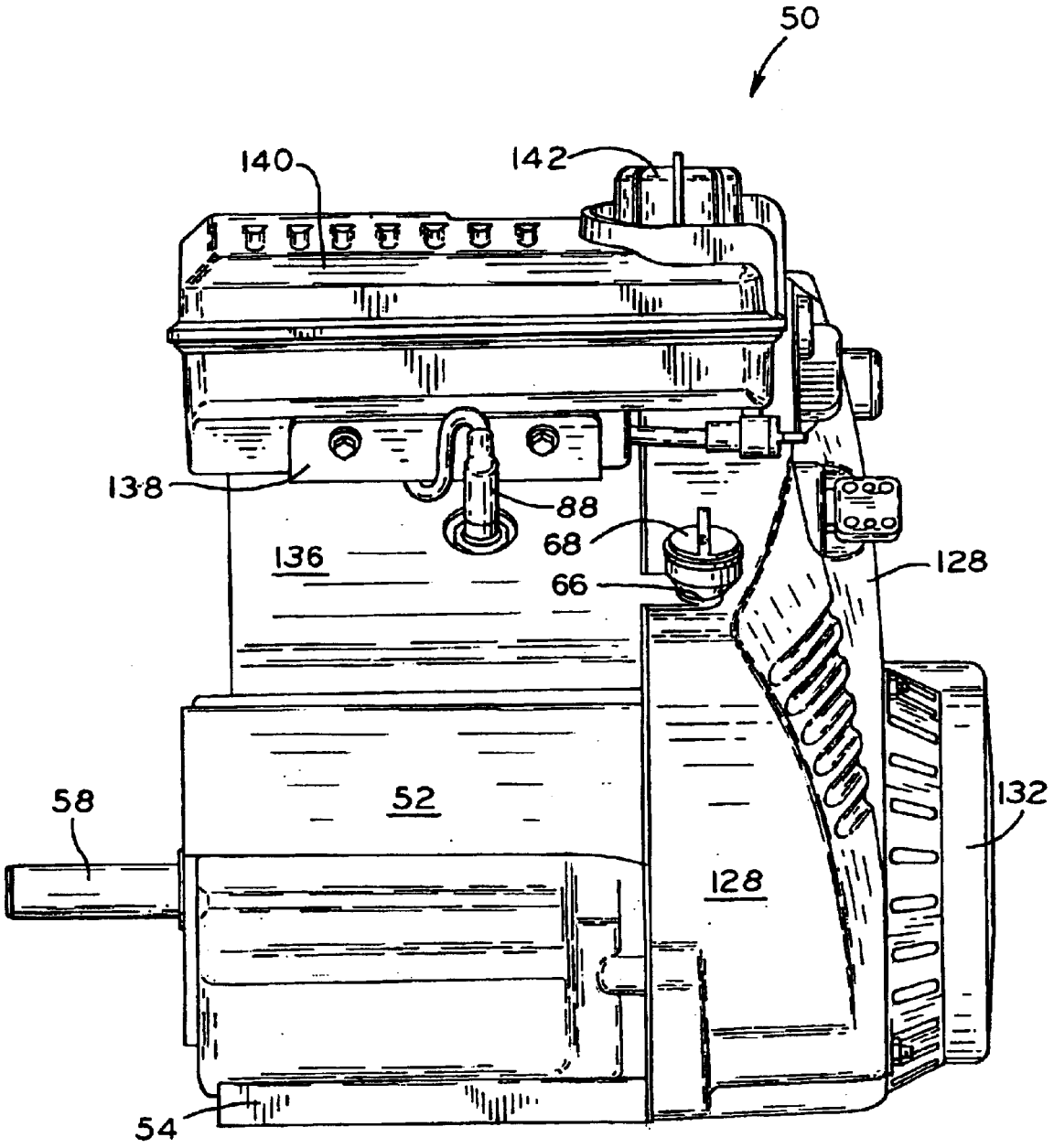
FIG. 4 is a left side view of the engine of FIG. 1.
Figure 5:
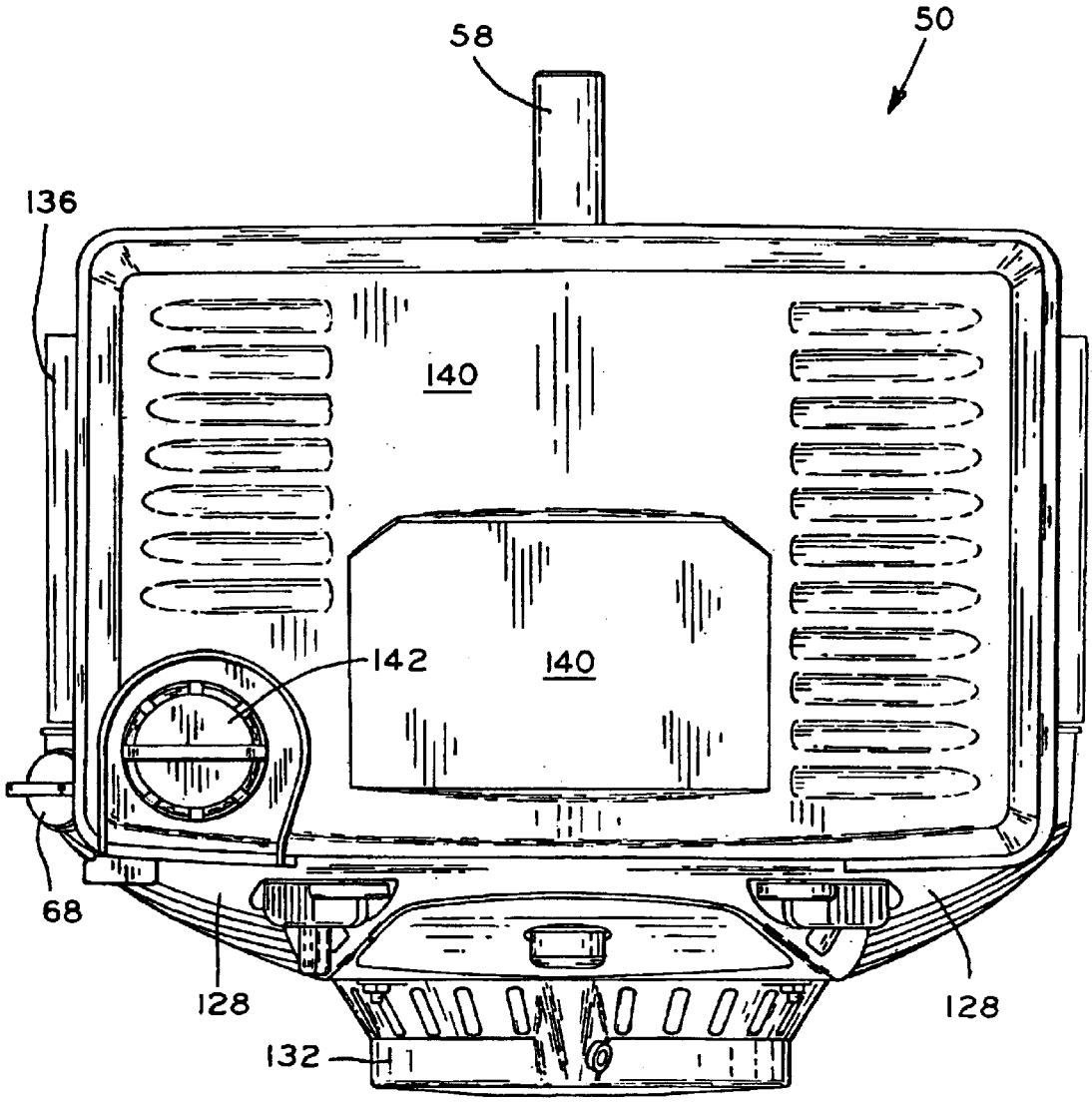
FIG. 5 is a top view of the engine of FIG. 1.
Figure 6:
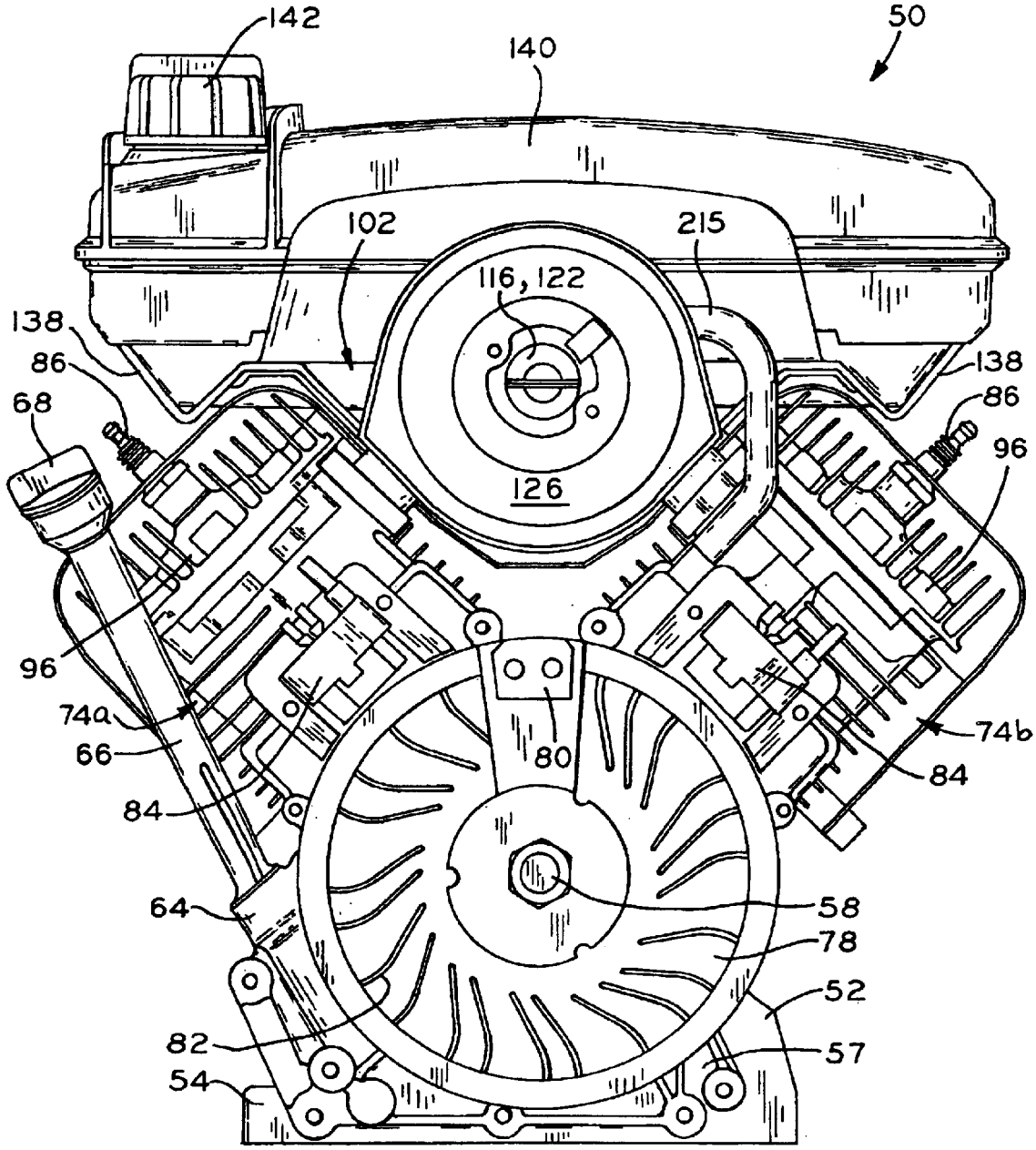
FIG. 6 is a front elevational view of the engine of FIG. 1, with the shroud removed to show the crankcase, a pair of cylinder members mounted to the crankcase, an intake assembly associated with the cylinder members, and a flywheel mounted to the crankshaft.
Figure 7:
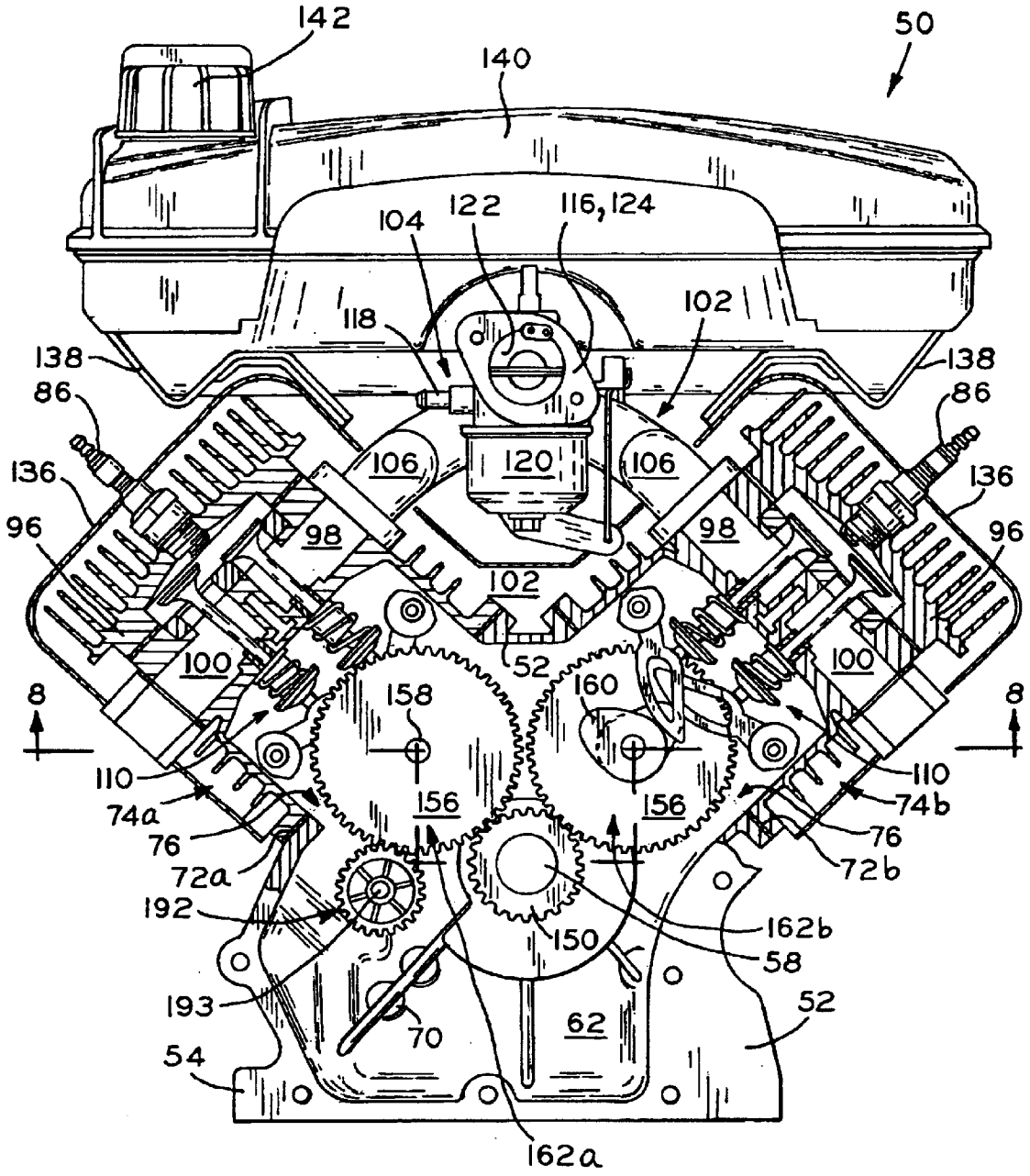
FIG. 7 is a front elevational view of the engine of FIG. 6, in which the crankcase cover and flywheel have been removed, the cylinder members and a portion of the crankcase in section to show the valve train of the engine.
Figure 8:
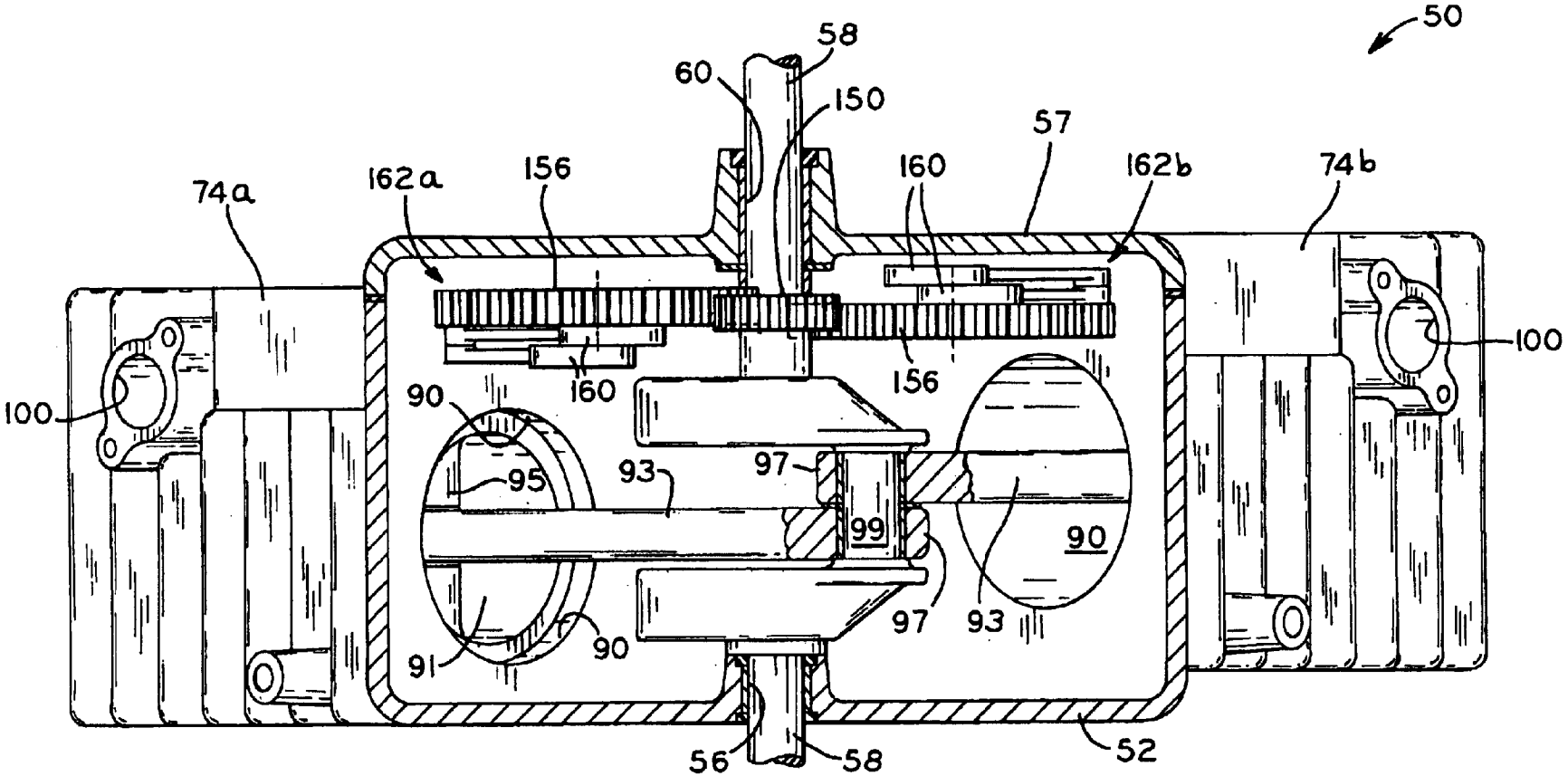
FIG. 8 is a sectional view taken along line 8—8 of FIG. 7.
Figure 13:
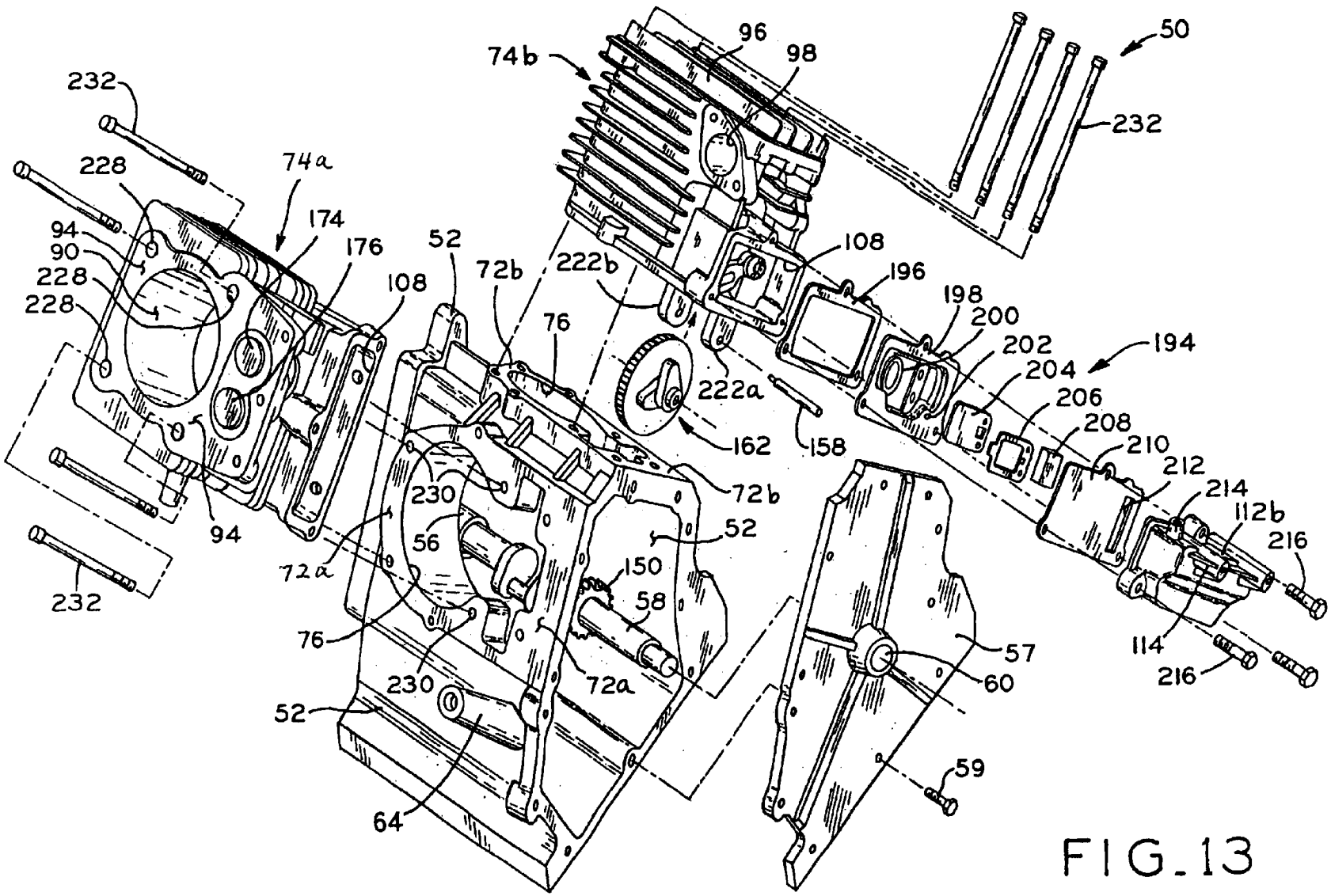
FIG. 13 is an exploded view of the crankcase, crankcase cover, and cylinder members of the engine of FIGS. 1–7, showing the attachment of the crankcase cover and cylinder members to the crankcase, and further showing an exploded view of the breather assembly of one of the cylinder members.

Referring first to FIGS. 1, 6, and 7, engine 50 includes crankcase 52, having base portion 54 for connection of the engine to, or for supporting the engine on, an implement (not shown) with which engine 50 is used, such as a snow thrower, generator, lawn tractor, small sport vehicle, or other small working implement or vehicle. Referring to FIGS. 8 and 13, crankcase 52 includes first crank bearing 56 in a rear wall thereof, in which one end of crankshaft 58 is journalled for rotation. Crankcase cover 57, shown in FIGS. 8, 13, and 14, is attached to crankcase 52 with suitable fasteners 59 (FIG. 13) to enclose crankcase 52 and includes second crank bearing 60, disposed opposite first crank bearing 56, in which the opposite end of crankshaft 58 is journalled for rotation. Each of first and second crank bearings 56, 60 is a full bearing provided in crankcase 52 and in crankcase cover 57, respectively.

Referring to FIG. 7, crankcase 52 includes oil sump 62 therein, in which a quantity of lubricating oil is contained. Oil may be filled into crankcase 52 through oil fill opening 64 (FIGS. 6 and 13) formed integrally with crankcase 52, to which oil fill conduit 66 may be attached. As shown in FIG. 6, oil fill conduit 66 is a tubular member formed of a suitable plastic material, and includes a removable oil fill cap 68. Referring to FIG. 7, a plurality of reinforced portions or bosses 70 are formed integrally within crankcase 52, which may be used as attachment points for attaching an output component to engine 50, such as a transmission or a working device, for example.

Referring to FIGS. 7 and 13, crankcase 52 includes a pair of mounting surfaces 72*a* and 72*b* for attachment thereto of cylinder members 74*a* and 74*b*, respectively. Mounting surfaces 72*a* and 72*b* are shown disposed at a 90° angle with respect to one another, thereby positioning cylinder members 74*a* and 74*b* at a 90° angle with respect to one another. Alternatively, the angle between mounting surfaces 72*a* and 72*b*, and in turn the angle between cylinder members 74*a* and 74*b*, may be varied as desired. Mounting surfaces 72*a* and 72*b* include openings 76 therein into which certain valve train components of cylinder members 74*a* and 74*b* are inserted when cylinder members 74*a* and 74*b* are attached to mounting surfaces 72*a* and 72*b* of crankcase 52, as described below. Mounting surfaces 72*a* and 72*b* may be reinforced, for example, by casting same to a thickness greater than that of the remainder of crankcase 52, by insert molding one or more plates in crankcase 52 around openings 76 which is made from a material harder than that of crankcase 52, or by securing such plate(s) to mounting surfaces 72*a* and 72*b* around openings 76 after crankcase 52 is cast.

Referring to FIG. 6, crankshaft 58 includes flywheel 78 mounted to an end thereof which extends externally of crankcase cover 57. Flywheel 78 includes permanent magnet 80 disposed between fins 82 thereof. Electronic ignition modules 84 are connected one to each of cylinder members 74*a* and 74*b* as described below, and are positioned closely adjacent the outer periphery of flywheel 78 adjacent permanent magnet 80. Electronic ignition modules 84 are operably connected to spark plugs 86 of engine 50 by leads 88, shown in FIGS. 1–4, such that rotation of flywheel 78 causes permanent magnet 80 to pass near each electronic ignition module 84 to induce an ignition spark in each spark plug 86 in a conventional manner. Additionally, a starter (not shown) is attached to crankcase 52, and engages flywheel 78 to rotate crankshaft 58 for starting engine 50.

Figure 9:
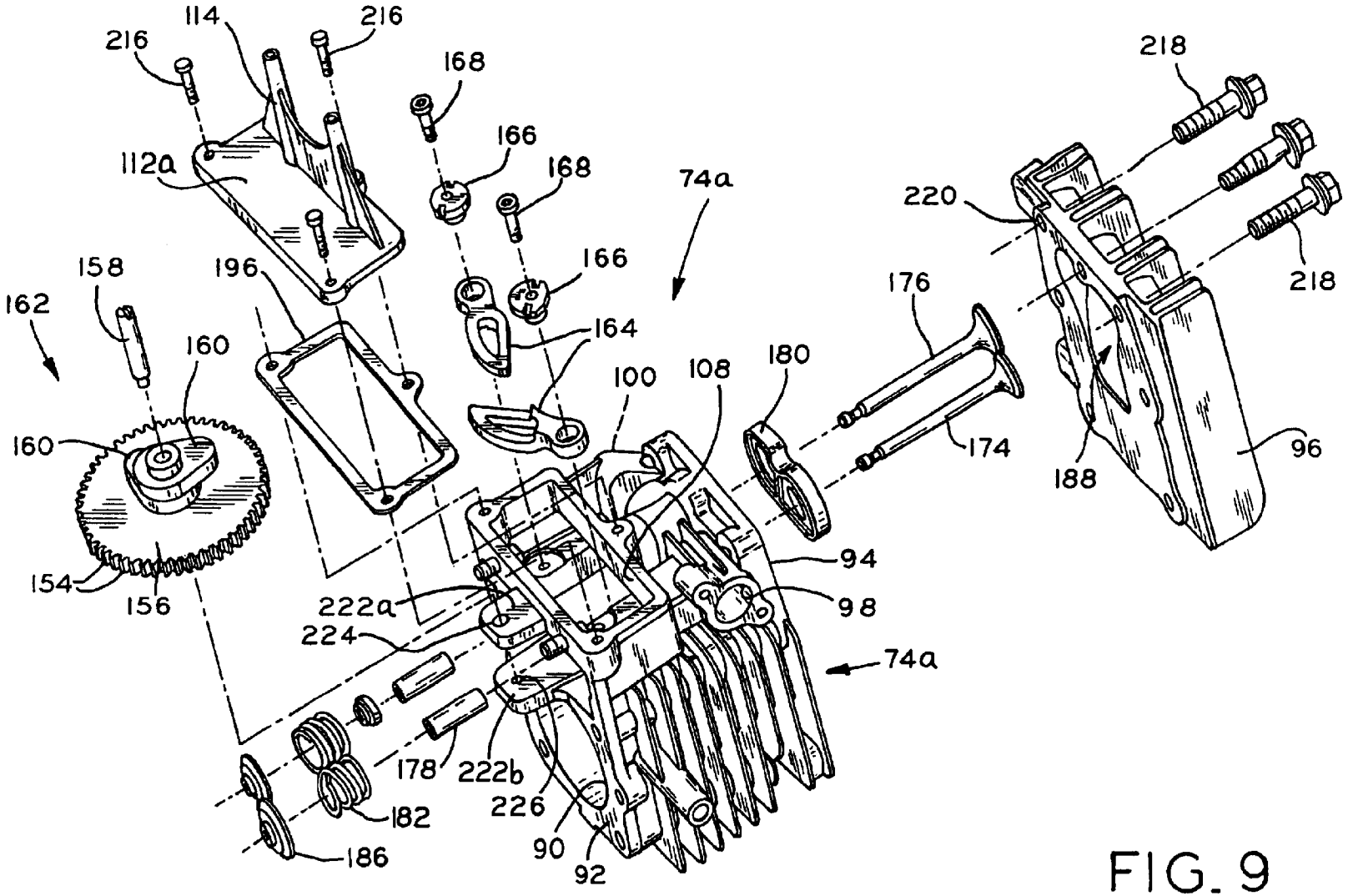
FIG. 9 is an exploded view of a cylinder member of the engine, showing the components of the valve train and a cylinder head.
Figure 11:
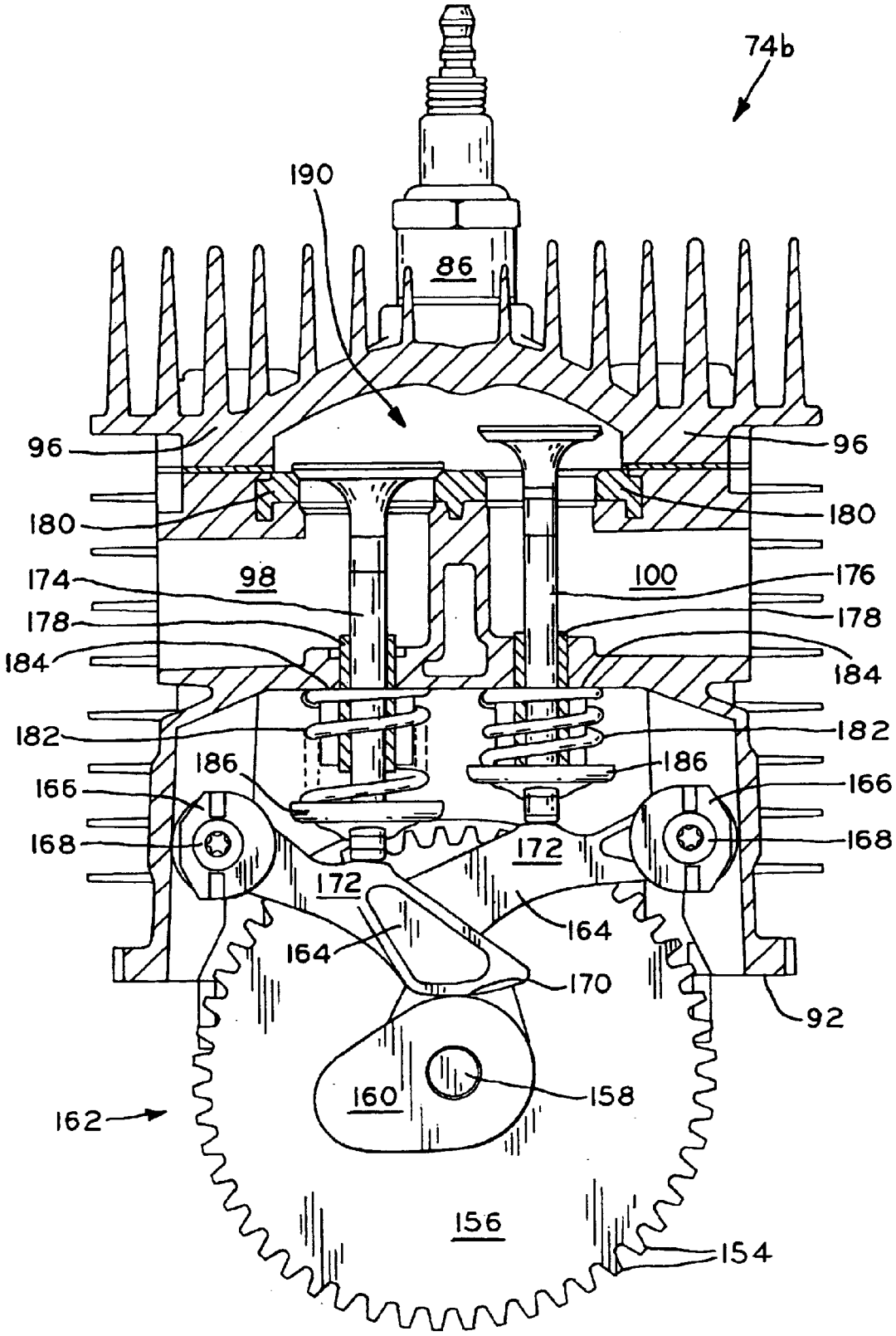
FIG. 11 is a sectional view through the cylinder member of FIG. 10, taken along line 11—11 of FIG. 10.

Referring to FIGS. 8 and 9, cylinder members 74*a* and 74*b* each generally include a cylinder bore 90 for slidable receipt of a piston 91 therein, as well as mounting surfaces 92 for attachment to mounting surfaces 72*a* and 72*b* of crankcase 52, and upper attachment faces 94 for attachment thereto of cylinder heads 96. Alternatively, cylinder heads 96 may be integrally formed with cylinder members 74*a* and 74*b*. Referring additionally to FIGS. 7 and 11, cylinder members 74*a* and 74*b* each include intake port 98 and exhaust port 100, with intake port 98 formed in a first side of each cylinder member 74*a* and 74*b*, and exhaust port 100 formed in a second side of each cylinder member 74*a* and 74*b* opposite the first side in which intake port 98 is formed.

As shown in FIGS. 6 and 7, a V-space 102 is defined between cylinders under members 74*a* and 74*b*. Referring to FIG. 7, the cylinder members 74*a* and 74*b* are mounted to crankcase 52 such that intake ports 98 of each of cylinder members 74*a* and 74*b* are disposed adjacent or within, the V-space 102, and the exhaust ports 100 of each of cylinder members 74*a* and 74*b* are disposed on a side of cylinder members 74*a* and 74*b* which is opposite intake ports 96 an which therefore faces outwardly from V-space 102. The positioning of intake ports 98 and exhaust ports 100 which is provided by the configuration of cylinder members 74*a* and 74*b* advantageously places intake ports 98 close to one another, thus allowing intake assembly 104 of engine 50 to be disposed within V-space 102, while minimizing the length of intake pipes 106 of intake assembly 104. Additionally, the positioning of exhaust ports 100 outwardly of V-space 102 and to the sides of engine 50 readily exposes same to cooling air from flywheel 78, and further, the accumulation of an excessive amount of heat within V-space 102 is avoided by positioning exhaust ports 100 to the sides of engine 50 where the heat therefrom may be readily dissipated.

Figure 10:
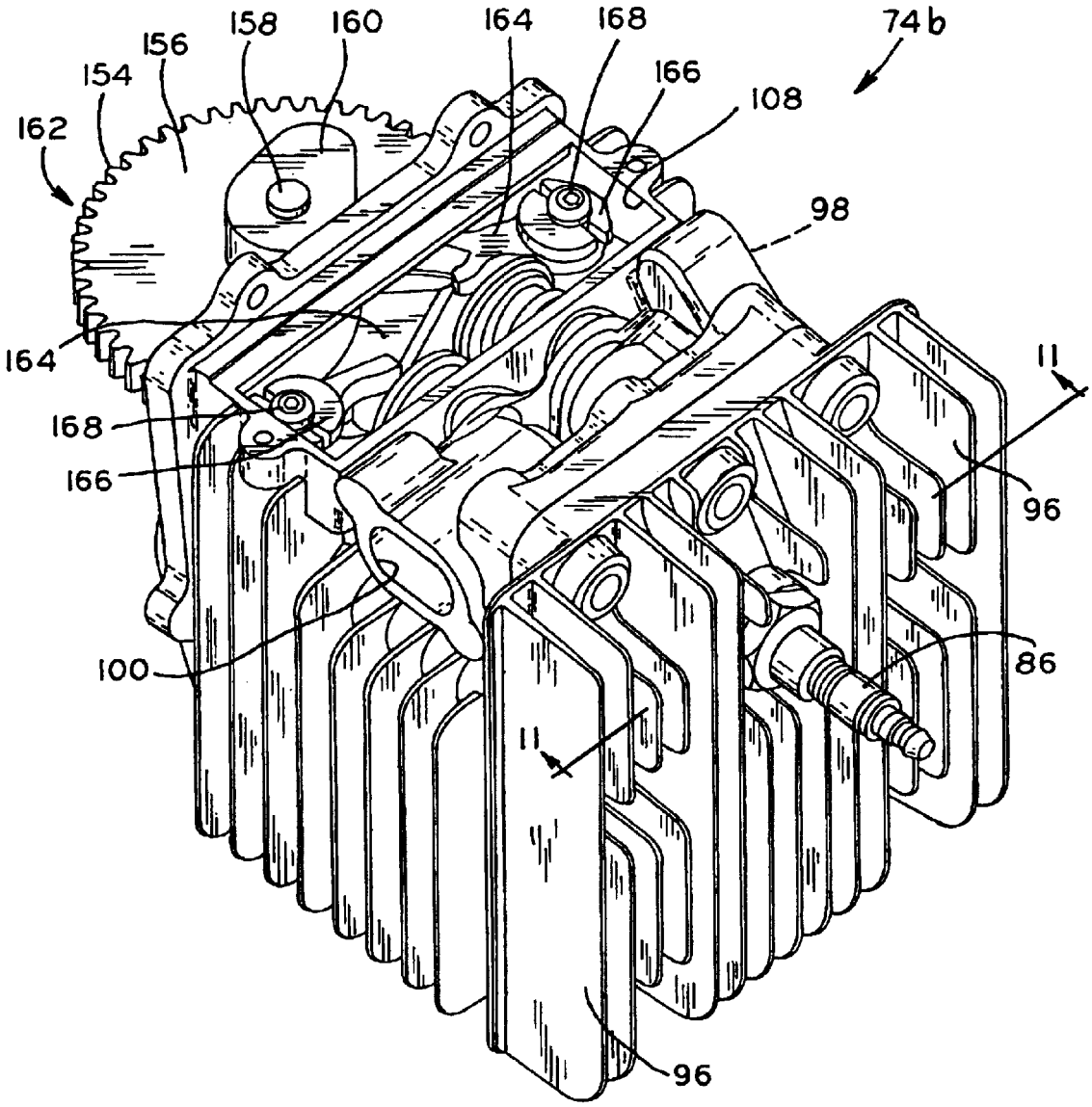
FIG. 10 is an assembled view of the cylinder member of FIG. 9.

Referring to FIGS. 9, 10, and 13, cylinder members 74*a* and 74*b* also each include rectangular-shaped openings 108 therein which provide access to the interior of cylinder members 74*a* and 74*b*, including the components of valve train 110 of engine 50, as described below. Openings 108 are covered by cylinder member covers 112*a*, 112*b*, the details of which are discussed below. Cylinder member covers 112*a*, 112*b* include integral posts 114, best shown in FIGS. 9, 13 and 14, to which electronic ignition modules 84 (FIG. 6) are attached to support and position electronic ignition module 84 adjacent the peripheral edge of flyweight 78 adjacent permanent magnet 80.

Referring to FIGS. 6 and 7, intake assembly 104 includes carburetor 116 having fuel inlet 118, fuel bowl 120, and throat 122 extending therethrough in which throttle and choke valves (not shown) are rotatably mounted. Intake pipes 106 extend between an outlet end (not shown) of carburetor 116 and intake ports 98 of cylinder members 74*a* and 74*b*. Carburetor 116 also includes mounting flange 124 on its inlet side, shown in FIG. 7, for attachment of air cleaner plate 126 thereto. Air cleaner plate 126 cooperates with shroud 128 and air cleaner cover 130, shown in FIGS. 1 and 2, to define an enclosed air cleaner cavity in which an air cleaner or filter element (not shown) is positioned for filtering debris from intake air before same enters carburetor 116.

Further details regarding the air intake system of the engines disclosed herein are set forth in U.S. patent application Ser. No. 10/408,882, entitled AIR CLEANER ASSEMBLY FOR INTERNAL COMBUSTION ENGINES, filed on Apr. 8, 2003, assigned to the assignee of the present invention, the disclosure of which is expressly incorporated herein by reference. Also, further details regarding the operation of carburetor 116, including the choke and throttle controls thereof, as well as the operation of other user interfaces of engine 50, are set forth in U.S. patent application Ser. No. 10/409,202, entitled ENGINE CONTROL SYSTEM, filed on Apr. 8, 2003, assigned to the assignee of the present invention, the disclosure of which is expressly incorporated herein by reference.

Referring to FIGS. 1–5, shroud 126 is attached to crankcase 52 and cylinder members 74*a* and 74*b*, and substantially covers the front side of crankcase 52, including flywheel 78, and also the front side of cylinder members 74*a* and 74*b*. Air inlet screen 132 is attached to shroud, and may cover a recoil starter mechanism (not shown) attached to crankshaft 52 in applications where engine 50 does not include an electric starter motor. Air inlet screen 132 includes a plurality of louvers 134 therein into which intake air may be drawn by flywheel 78 into the area between crankcase 52 and shroud 128, which intake air is directed by shroud 128 to the air cleaner cavity beneath air cleaner cover 130 for combustion within engine 50. Also, air may be directed by shroud 128 and cylinder wraps 136 around cylinder members 74*a* and 74*b* for cooling same during running of engine 50.

Cylinder wraps 136, shown in FIGS. 1–4, 6, and 7, may be made of a relatively thin sheet metal, for example, and are attached to crankcase 52 and cylinder members 74*a* and 74*b* for directing cooling air closely around cylinder members 74*a* and 74*b*. Brackets 138 are attached to cylinder wraps 136 adjacent the upper ends of cylinder members 74*a* and 74*b*, and fuel tank 140 is in turn attached to brackets 140 with suitable fasteners. Fuel tank 140 has a broad, relatively thin horizontal profile, and is mounted to the upper end of engine 50 above the upper ends of cylinder members 74*a* and 74*b*. Advantageously, as shown in FIGS. 7 and 8, because brackets 138 are respectively disposed above cylinder members 74*a* and 74*b* and are spaced relatively far from one another, the weight of fuel tank 140 is distributed over a relatively large area of engine 50. Fuel tank 140 includes a filler neck (not visible) to which fuel tank cap 142 is attached, which may be removed for filling fuel into fuel tank 140.

Referring generally to FIGS. 9–12, the valve train 110 of engine 50 is shown, which is configured as a side valve or "L-head" valve train. Drive gear 150 is mounted to crankshaft 58, and includes teeth 152 which mesh with teeth 154 of cam gears 156 to drive cam gears 156 at one-half the speed of crankshaft 58. Cam gears 156 are rotatably mounted on shafts 158 which are connected to cylinder members 74*a* and 74*b* in the manner described below. Cam gears 156 also each include at least one cam lobe 160 which may be integrally formed with cain gears 156 to thereby form cam gear and lobe assemblies 162. For example, cam gear and lobe assemblies 162 may be formed as an integral piece of a molded rigid plastic material. Alternatively, cam gears 156 and cam lobes 160 may be formed as separate components which are secured to one another in a suitable manner.

Referring to FIG. 8, pistons 91 of each cylinder member 74*a* and 74*b* are slidably disposed within cylinder bores 90. Connecting rods 93 are each attached at one end thereof to a piston 91 by wrist pin 95, and are attached at an opposite end thereof to crank pin 99 by split cap 97. Connecting rods 93 are staggered along crank pin 99 of crankshaft 58, and therefore cylinder bores 90 within cylinder members 74*a* and 74*b* are also staggered with respect to one another, as may be seen in FIG. 8.

To conserve space within crankcase 52, as shown in FIGS. 7 and 8, it may be seen that a first cam gear and lobe assembly 162*a* is disposed in a first orientation, and a second cam gear and lobe assembly 162*b* is disposed in an orientation which is rotated 180° with respect to the orientation of the first cam gear and lobe assembly 162*a*. Alternatively stated, a first cam gear and lobe assembly 162*a* faces in a first direction (i.e., toward the rear of engine 50) and a second cam gear and lobe assembly 162*b* faces in a second direction opposite the first direction (i.e., toward the front of engine 50). Correspondingly, the lobe(s) 160 of the first cam gear and lobe assembly 162*a* face in a first direction (i.e., toward the rear of engine 50), and the lobe(s) 160 of the second cam gear and lobe assembly 162*b* face in an opposite direction (i.e., toward the front of engine 50). As may be seen from FIG. 8, with the foregoing construction, space in crankcase 52 is conserved even though cylinder bores 90 and connecting rods 93 are staggered with respect to one another, and cam gears 156 may each be driven from a single, relatively thinly-profiled drive gear 150 mounted to crankshaft 58.

Figure 12:
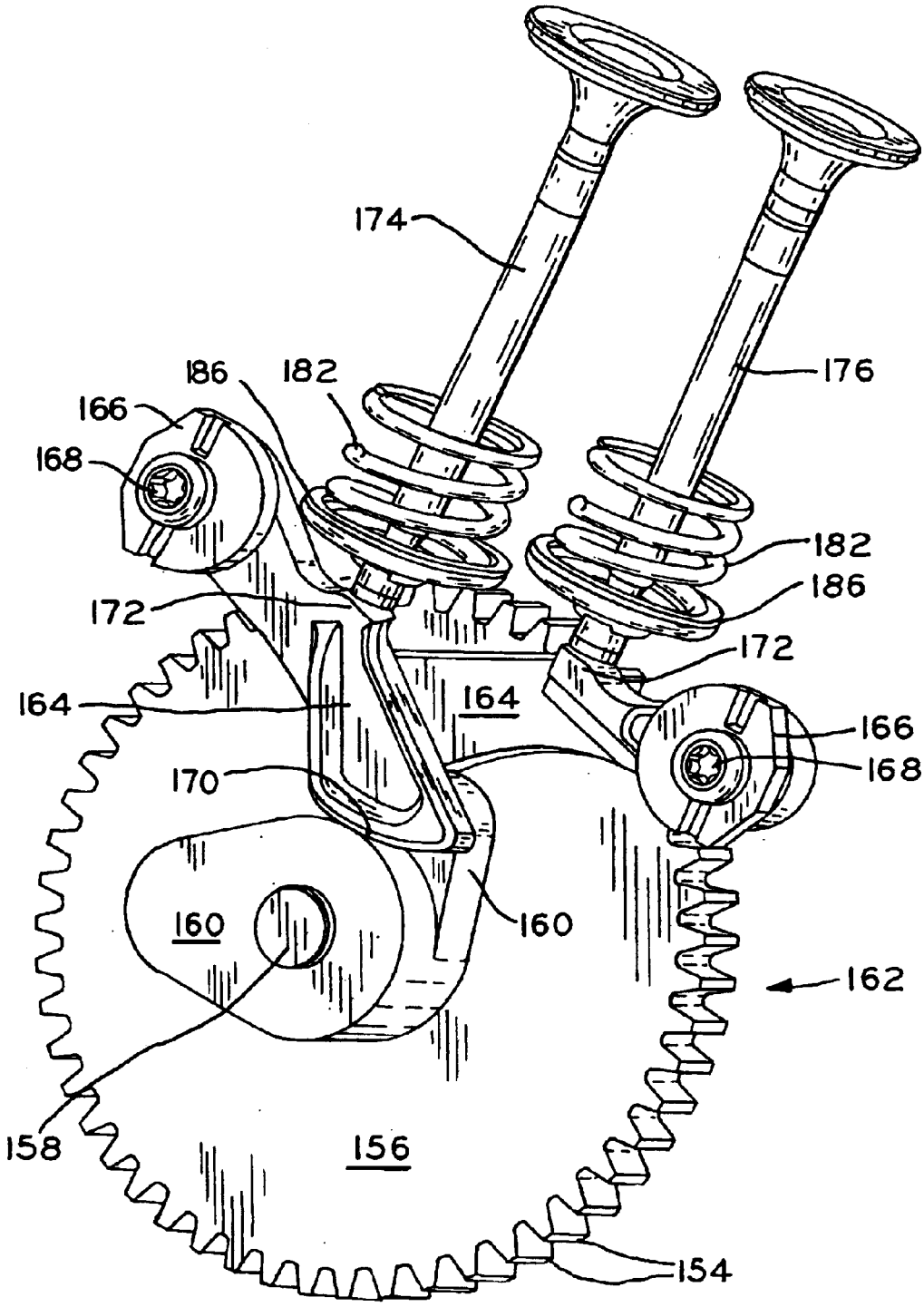
FIG. 12 is a perspective view of components of the valve train within the cylinder member of FIGS. 9–11.

Referring to FIGS. 9–12, rotation of cam gears 156 causes cam lobes 160 to periodically actuate lifters 164, which are pivotally mounted upon off-center adjusters 166, which are in turn secured to cylinder members 74*a* and 74*b* by mounting bolts 168. As shown in FIGS. 11 and 12, lifters 164 each include follower portion 170 in engagement with cam lobes 160, and actuator portion 172 in engagement with intake and exhaust valves 174 and 176, respectively, which are slidably carried within valve guides 178 of cylinder members 74*a* and 74*b*. Within each cylinder member 74*a* and 74*b*, intake and exhaust valves 174 and 176 are disposed radially adjacent cylinder bore 90. Intake and exhaust valves 174 and 176 are seated within valve seats 180 which may be integrally cast into cylinder members 74*a* and 74*b*. Alternatively, value seats 180 may be formed as separate components which are press-fitted into cylinder members 74*a* and 74*b*, as shown in FIGS. 9 and 11. Valve springs 182 are coiled about each of intake and exhaust valves 174 and 176 under compression between spring seats 184 (FIG. 11) of cylinder members 74*a* and 74*b* and valve keepers 186, and normally bias intake and exhaust valves 174 and 176 to a closed position wherein intake and exhaust valves 174 and 176 are seated against valve seats 180.

Referring to FIGS. 9 and 11, cylinder heads 96 include depressions 188 which, together with the upper ends of cylinder bores 90 of cylinder members 74*a* and 74*b*, define combustion chambers 190 in which the spark gap end of spark plugs 86 project. Spark plugs 6 are actuated by the ignition system of engine 50 for igniting a compressed air/fuel mixture within combustion chambers 190 to drive engine 50 according to a conventional four-stroke cycle, in which valve train 110 of engine 50 is operable as described above to periodically introduce an air/fuel combustion mixture into combustion chambers 190 and to allow combustion products to evacuate combustion chambers 190 after combustion therein.

As shown in FIG. 7, one of cam gears 156 may drive governor mechanism 192, which may be rotatably supported upon stub shaft 193 connected to either crankcase 52 or to crankcase cover 57. Alternatively, governor mechanism 192 may supported upon a shaft journalled in bearings provided in crankcase 52 and/or in crankcase cover 57. Governor mechanism 192 is operably connected to carburetor 116 of intake assembly 104 to regulate the mass fuel/air intake of engine 50 in response to engine speed and engine load.

During running of engine 50, the moving parts within crankcase 52, such as crankshaft 58, oil slingers or dippers (not shown) attached to the connecting rods 93 of the engine, and governor mechanism 192, create an oil mist within crankcase 52 which, under the pressure fluctuations generated by the pistons reciprocating within cylinder members 74*a* and 74*b*, is forced into cylinder members 74*a* and 74*b* to lubricate valve train 110, including cam gears 156, lifters 164, and intake and exhaust valves 174 and 176. Upon condensation, the oil may drip back into crankcase 52 from cylinder members 74*a* and 74*b*.

Additionally, one of the cylinder members 74*a* and 74*b*, such as cylinder member 74*b*, for example, includes breather assembly 194, shown in FIG. 13, for venting blow-by gasses from crankcase 52. Breather assembly 194 includes gasket 196 made of a flexible, compressible material such as rubber; breather plate 198 having valve seat/opening 200 and drain holes 202; flapper valve 204 made of a flexible material such as spring steel; valve retainer 206 made of a rigid material; filter media 208 made of a porous material; breather plate cover 210 made of a flexible, compressible material such as rubber and having opening 212 therein; and cylinder member cover 112*b* having hose fitting 214. Bolts 216 pass successively through apertures in cylinder cover member 112*b*, breather plate cover 210, breather plate 198, gasket 196, and into apertures in cylinder member 74*b* to thereby cover opening 108 of cylinder member 74*b* and to assemble breather assembly 194 to cylinder member 74*b*. As shown in FIG. 13, breather assembly 194 is attached only to cylinder member 74*b*, and opening 108 of cylinder member 74*b* is covered by gasket 196 and cylinder cover member 112*a* attached thereto by bolts 216. Alternatively, if desired, both cylinder members 74*a* and 74*b* may include breather assemblies 194.

In operation, blow-by gasses, which pass around the pistons 91 from combustion chambers 190 into crankcase 52 during running of engine 50, tend to accumulate within crankcase 52 and increase the pressure therein. When such pressure increases to a certain level, the blow-by gas pressure causes flapper valve 204 to flex against the bias force of valve retainer 206 away from valve seat/opening in breather plate 198 to vent the blow-by gasses from the interior of cylinder member 74*b* into a chamber defined between breather plate 198 and breather plate cover 210. In this chamber, oil separates from the blow-by gasses by gravity and condensation, and drips back into crankcase 52 through drain holes 202 in breather plate 198. Also, oil may be trapped within filter media 208. The blow-by gasses then pass through opening 212 in breather plate cover 210 and thereafter may exit cylinder member cover 112*b* through hose fitting 214. A breather conduit 215, shown in FIG. 6, is connected between hose fitting 214 of cylinder member cover 112*b* to convey the blow-by gasses to the air filter cavity of engine 50 for recycling.

The assembly of engine 50 will now be described. Notably, engine 50 may be assembled in a manner in which cylinder members 74*a* and 74*b*, and the components of valve train 110 which are attached to cylinder members 74*a* and 74*b*, are first assembled as packaged units and then subsequently attached to crankcase 52. For example, valve seats 180 may be press-fit into cylinder members 74*a* and 74*b*, as shown in FIG. 9, and intake and exhaust valves 174 and 176 may then be assembled to cylinder members 74*a* and 74*b*. As shown in FIG. 9, a plurality of bolts 218 may be inserted through apertures 220 in cylinder heads 96 and into holes (not shown) in cylinder members 74*a* and 74*b* to attach cylinder heads 96 to cylinder members 74*a* and 74*b* at a suitable point in the assembly process. Lifters 164 may then be assembled to off-center adjusters 166, secured by bolts 168 to cylinder members 74*a* and 74*b*.

As shown in FIG. 9, cam gear and lobe assemblies 162 may be attached to cylinder members 74*a* and 74*b* by first positioning cam gear and lobe assemblies 162 between ears 222*a* and 222*b* projecting from cylinder members 74*a* and 74*b*, followed by inserting shafts 158 through large aperture 224 in ear 222*a*, through the central aperture of cam gear and lobe assemblies 162, and into small aperture 226 in ear 222*b*.

After the components of valve train 110 are assembled to cylinder members 74*a* and 74*b* as described above, the clearance of intake and exhaust valves 174 and 176 may be adjusted. In particular, the construction of off-center adjusters 166, upon which lifters 164 are pivotally mounted, as well as the manner in which the value clearance or "valve lash" between actuator portions 172 of lifters 164 and their respective intake and exhaust valves 174 and 176 may be adjusted, is described in detail in U.S. patent application Ser. No. 10/262,455, filed on Oct. 1, 2002, entitled VALVE CLEARANCE ADJUSTMENT MECHANISM, assigned to the assignee of the present invention, the disclosure of which is expressly incorporated herein by reference. The foregoing valve clearance or "valve lash" of intake and exhaust valves 174 and 176 may adjusted either before or after cylinder members 74*a* and 74*b* are attached to crankcase 52, as described below.

Referring to FIG. 13, cylinder members 74*a* and 74*b* may be attached to crankcase 52 by inserting cam gear and lobe assemblies 162 of cylinder members 74*a* and 74*b* through openings 76 in mounting surfaces 72*a* and 72*b* of crankcase 52 and positioning cylinder members 74*a* and 74*b* in abutment with mounting surfaces 72*a* and 72*b* of crankcase 52 such that cooperating bores 228 in cylinder members 74*a* and 74*b* are in alignment with bores 230 in mounting surfaces 72*a* and 72*b* of crankcase 52. In this manner, it may be seen that cam gear and lobe assemblies 162 extend into crankcase 52 for meshing engagement thereof with drive gear 150 of crankshaft 58, as also shown in FIG. 7. Thereafter, a plurality of long bolts 232 are inserted through bores 228 in cylinder members 74*a* and 74*b* and into bores 230 in mounting surfaces 72*a* and 72*b* of crankcase 52 to attach cylinder members 74*a* and 74*b* to crankcase 52.

Cylinder heads 96 may be attached to cylinder members 74*a* and 74*b* either before or after cylinder members 74*a* and 74*b* are attached to crankcase 52. Specifically, as shown in FIG. 13, cylinder member 74*a* is attached to crankcase 52 before a cylinder head 96 is attached to cylinder member 74*a*. In this manner, a piston 91 and connecting rod 93 assembly (not shown in FIG. 13) may be inserted through cylinder bore 90 and attached to crank pin 99 of crankshaft 58 prior to attachment of the cylinder head 96 to cylinder member 74*a*.

Alternatively, as shown in FIG. 13, cylinder head 96 is attached to cylinder member 74*b* prior to attachment of cylinder member 74*b* to crankcase 52. In this manner, a piston 91 and connecting rod 93 assembly (not shown in FIG. 13) may be inserted through cylinder bore 90 of cylinder member 74*b* prior to attachment of cylinder head 96, and the connecting rod 93 is attached to crank pin 99 of crankshaft 58 after attachment of cylinder member 74*b* to crankcase 52.

After one cylinder member 74*a* or 74*b* is attached to crankcase 52 and the cam and gear assembly 162 thereof is brought into meshing engagement with drive gear 150 on crankshaft 58, the engine timing is then set in a suitable manner. Then, the other of cylinder member 74*a* or 74*b* is attached to crankcase 52 and the cam and gear assembly 162 thereof is brought into meshing engagement with drive gear 150 on crankshaft 58. Finally, a plurality of bolts 59 are used to attach crankcase cover 57 to crankcase 52, with an end of crankshaft 58 journalled in crank bearing 60 of crankcase cover 57.

Referring to FIGS. 15–24, engine 300 is shown as a vertical crankshaft, V-twin engine having an overhead valve ("OHV") valve train, as discussed in detail below. Engine 300 has several components which are identical to engine 15 discussed above, and like reference numerals have been used to identify such components. Engine 300 may, with minor modifications, also be configured as a horizontal crankshaft, V-twin engine. Engine 300 generally includes crankcase 302, crankcase cover 304, and a pair of cylinder members 306*a* and 306*b*, which are mounted to crankcase 302 in the same manner as discussed above with respect to engine 50. Further, engine 300 is assembled in substantially the same manner as engine 50, except as discussed below.

Figure 19:
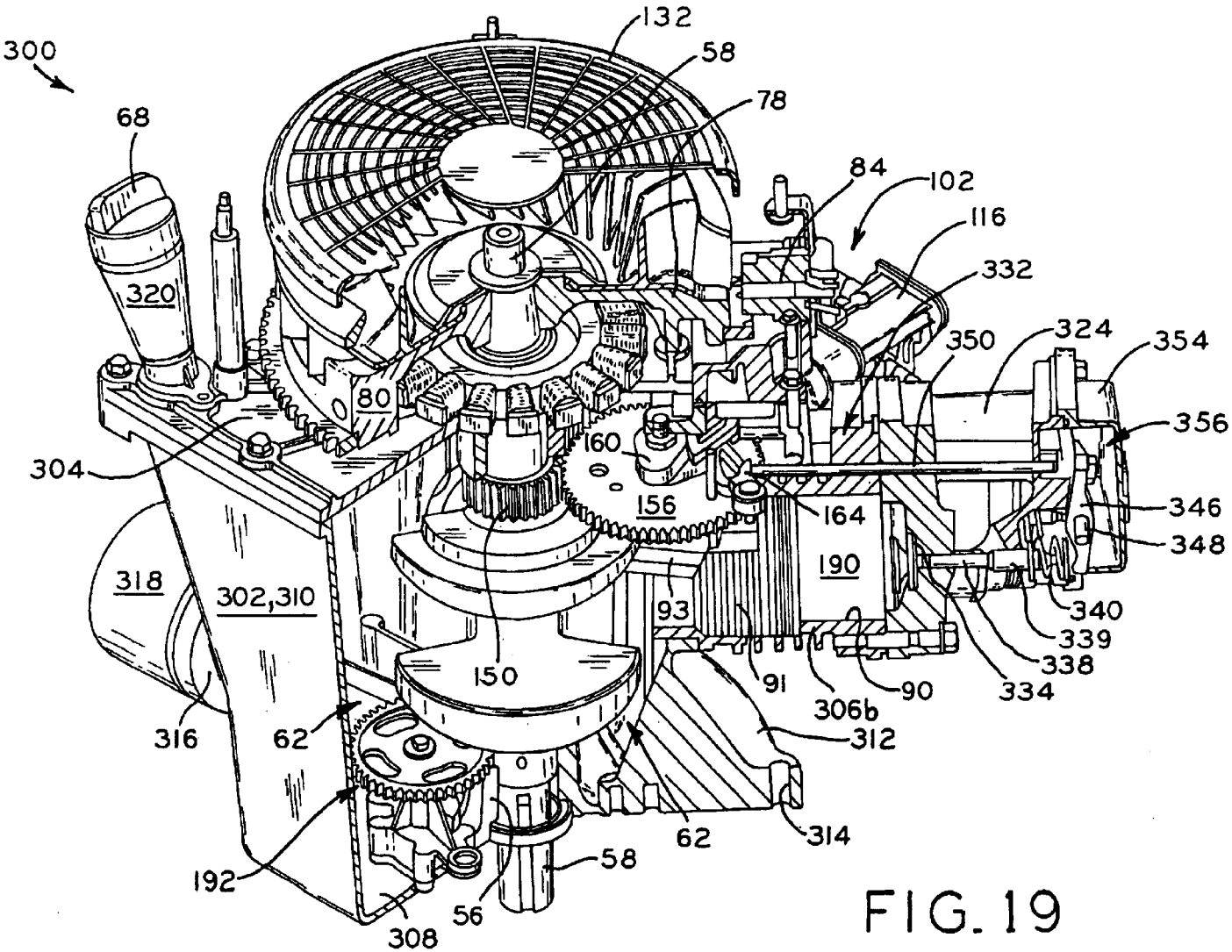
FIG. 19 is a rear perspective view of the engine of FIGS. 15–18, with a portion of the crankcase, crankcase cover, cylinder member, cylinder head, and cylinder hear cover cut away to show valve train components of engine.
Figure 20:
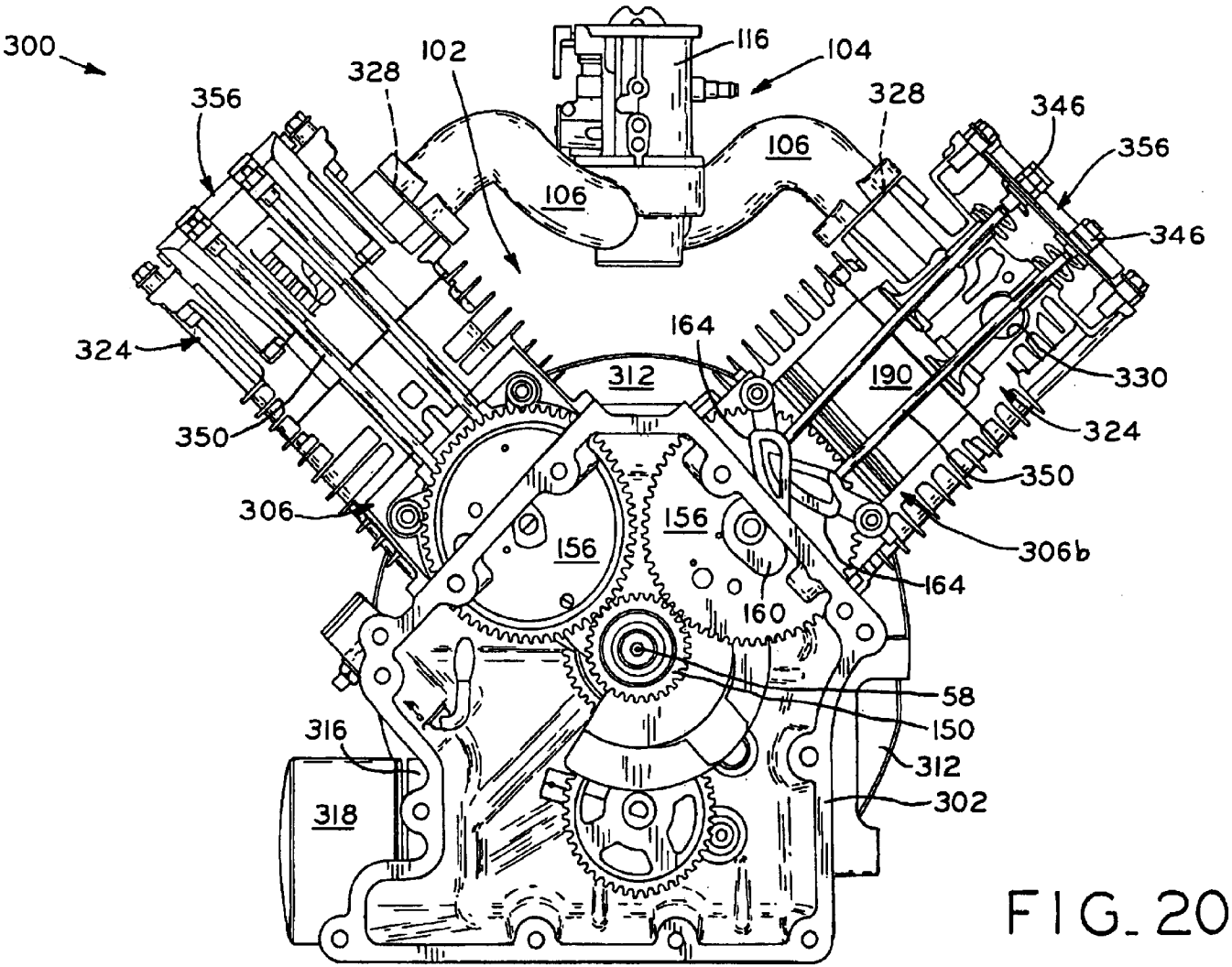
FIG. 20 is a top elevational view of the engine of FIGS. 15–19, with the crankcase cover removed and with the cylinder members and cylinder heads in section to show the valve train of the engine.

Referring first to FIG. 19, crankcase 302 includes bottom wall 308 having first crank bearing 56 therein. Side walls 310 depend upwardly from, and are integrally formed with, base wall 308. Side walls 310 are relatively elevated, such that crankcase 302 has a relatively deep, tub-like shape, with oil sump 62 entirely carried within crankcase 302, and crankcase cover 304 enclosing the open upper end of crankcase 302. The interface between crankcase 302 and crankcase cover 304 is disposed toward the top of engine 300, and not in the area of oil sump 62 as in known engines, thereby reducing the potential of oil leaks from oil sump 62 at such interface or elsewhere.

Figure 15:
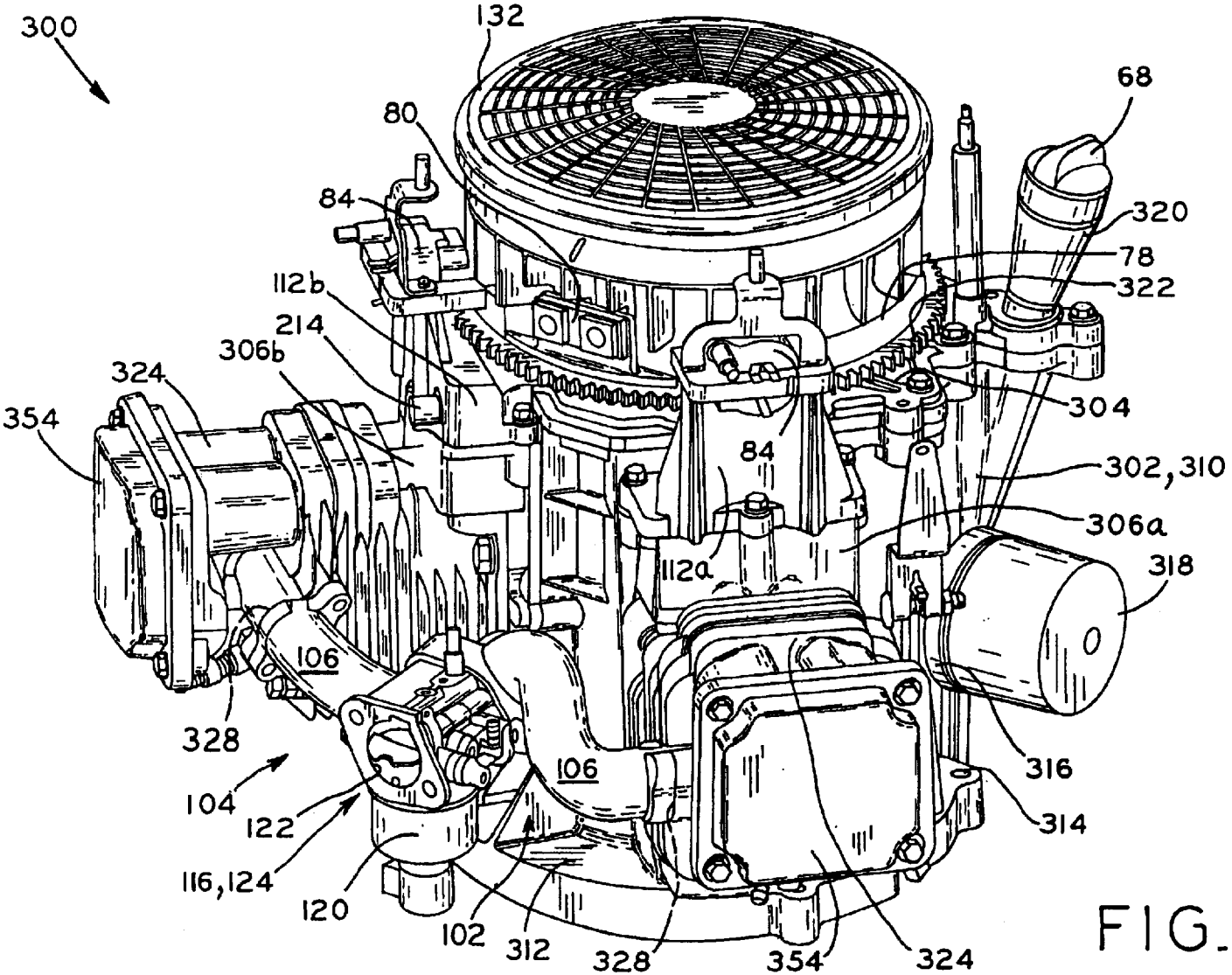
FIG. 15 is a perspective view of a vertical crankshaft, V-twin engine according to the present invention, the engine including an overhead valve ("OHV") valve train.
Figure 17:
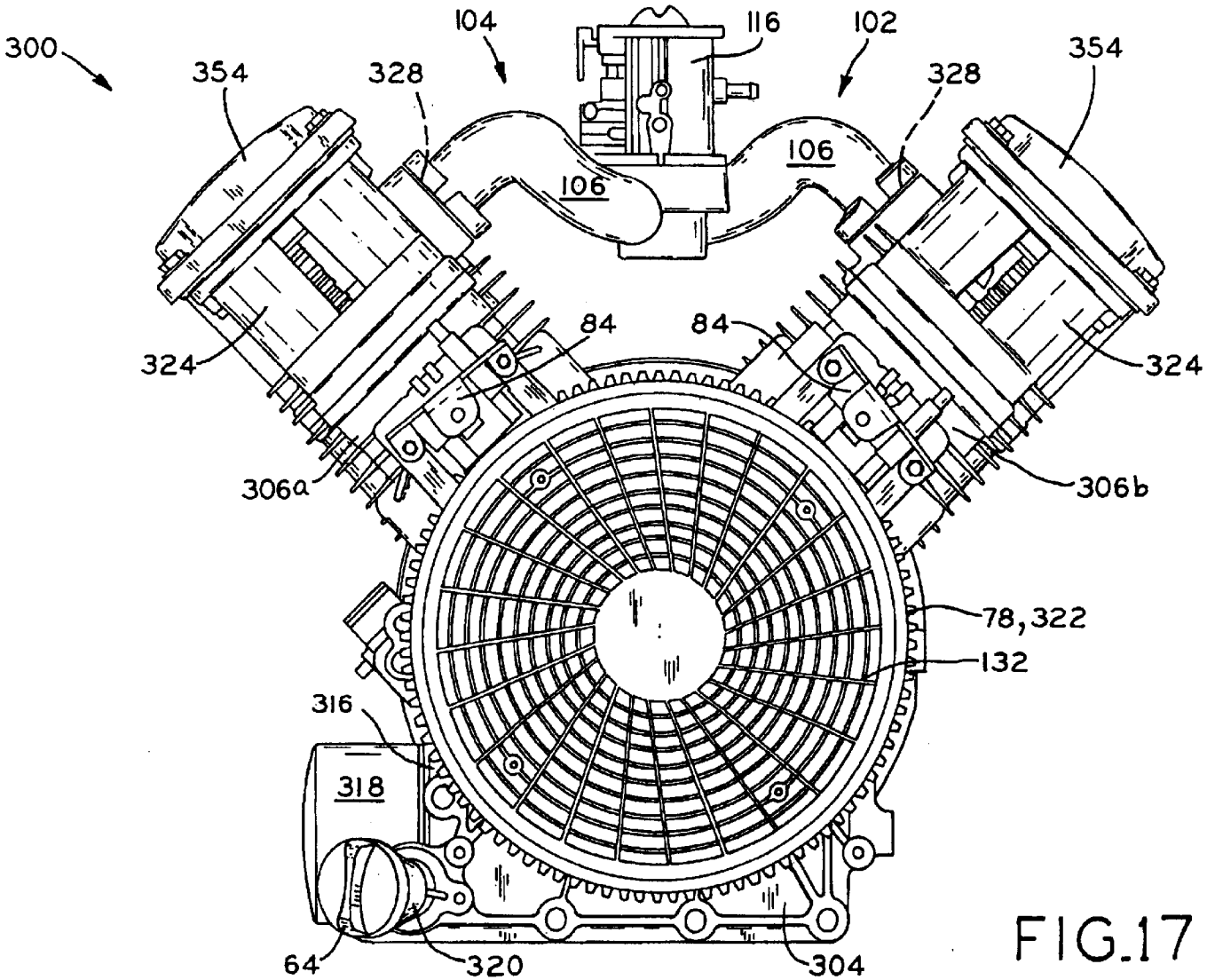
FIG. 17 is a top view of the engine of FIGS. 15 and 16.
Figure 18:
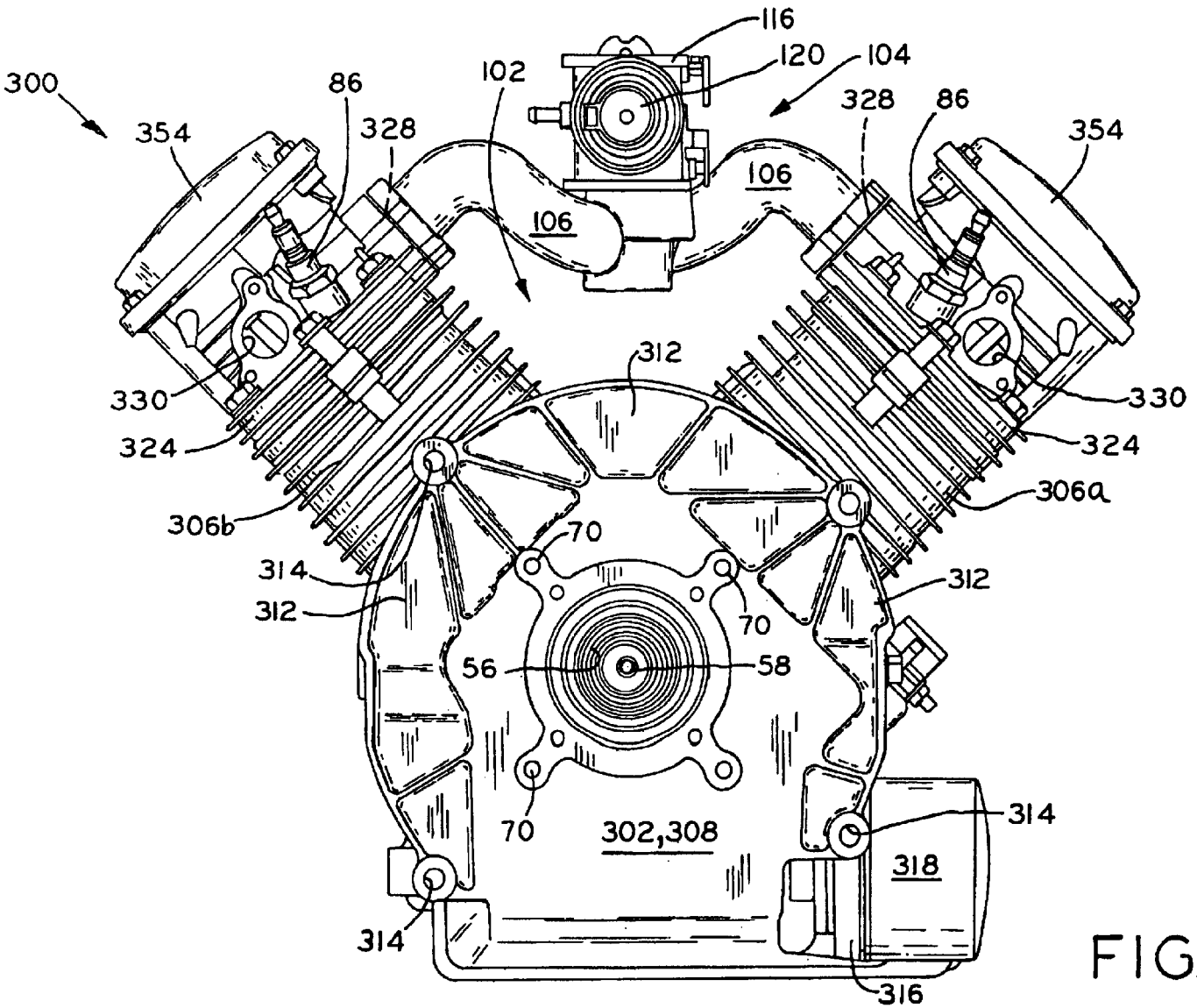
FIG. 18 is a bottom view of the engine of FIGS. 15–17.

Crankcase 302 includes an integral mounting flange 312 extending therefrom, which includes a series of apertures 314 through which fasteners (not shown) may be inserted for mounting engine 300 to an implement. As shown in FIGS. 15, 17, and 18, side wall 310 of crankcase 302 includes a fitting 316 for screw-threaded attachment of oil filter 318. Oil fill tube 320, shown in FIGS. 15 and 19, is attached to crankcase cover 304 in a suitable manner, and is in fluid communication with the interior of crankcase 302 for filling oil through oil fill tube 320 into oil sump 62. Oil fill tube 320 includes removable oil fill cap 68.

Figure 16:
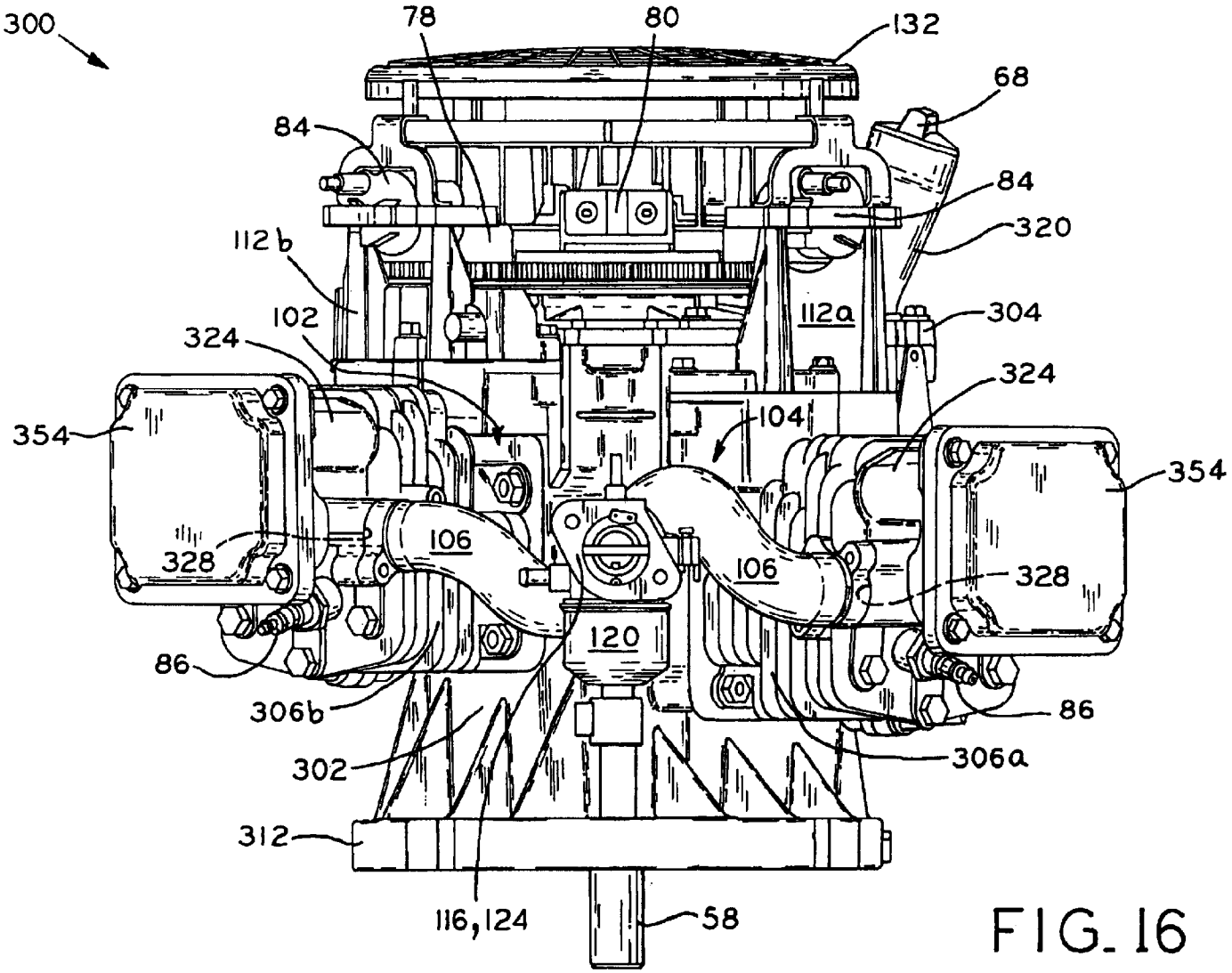
FIG. 16 is a front elevational view of the engine of FIG. 15.

Referring to FIGS. 15, 16, and 19, flywheel 78 is mounted to an end of crankshaft 58 which extends externally of crankcase cover 304, and has a plurality of teeth 322 around the outer periphery thereof which may be engaged by a suitable starter mechanism (not shown) to crank engine 300 for starting. The power take off ("PTO") end of crankshaft 58 extends externally of crankcase 302 therebelow for driving connection to a blade or other working device, for example. Air inlet screen 132 is disposed above flywheel 78, and is mounted to shroud 128 of engine 300. Intake air is drawn through air inlet screen 132 by rotation of flywheel 78 during running of engine 300.

As shown in FIGS. 15–20, the two cylinder assemblies, which include cylinder members 306*a* and 306*b* and their cylinder heads 324, define V-space 102 therebetween, and intake assembly 104, which includes carburetor 116 and intake pipes 106, is disposed within V-space 102. Cylinder heads 324 are mounted to the outer ends of cylinder members 306*a* and 306*b*, and enclose the ends of cylinder bores 90 within cylinder members 306*a* and 306*b* to define combustion chambers 190. Cylinder heads 324 additionally include intake ports 328 and exhaust ports 330. Intake ports 328 are disposed within a wall of cylinder heads 324 which faces inwardly within V-space 102 for connection of intake pipes 106 to intake ports 328. Exhaust ports 330 are disposed within a wall of cylinder heads 324 which is spaced approximately 90° from the wall in which intake ports 328 are disposed. As shown in FIG. 18, exhaust ports 330 face toward the bottom of engine 300; however, the foregoing configuration may be modified. For example, exhaust ports 330 may be disposed in a wall of cylinder heads 324 which is disposed opposite V-space 102, such that exhaust ports 330 face outwardly toward respective sides of engine 300.

Figure 21:
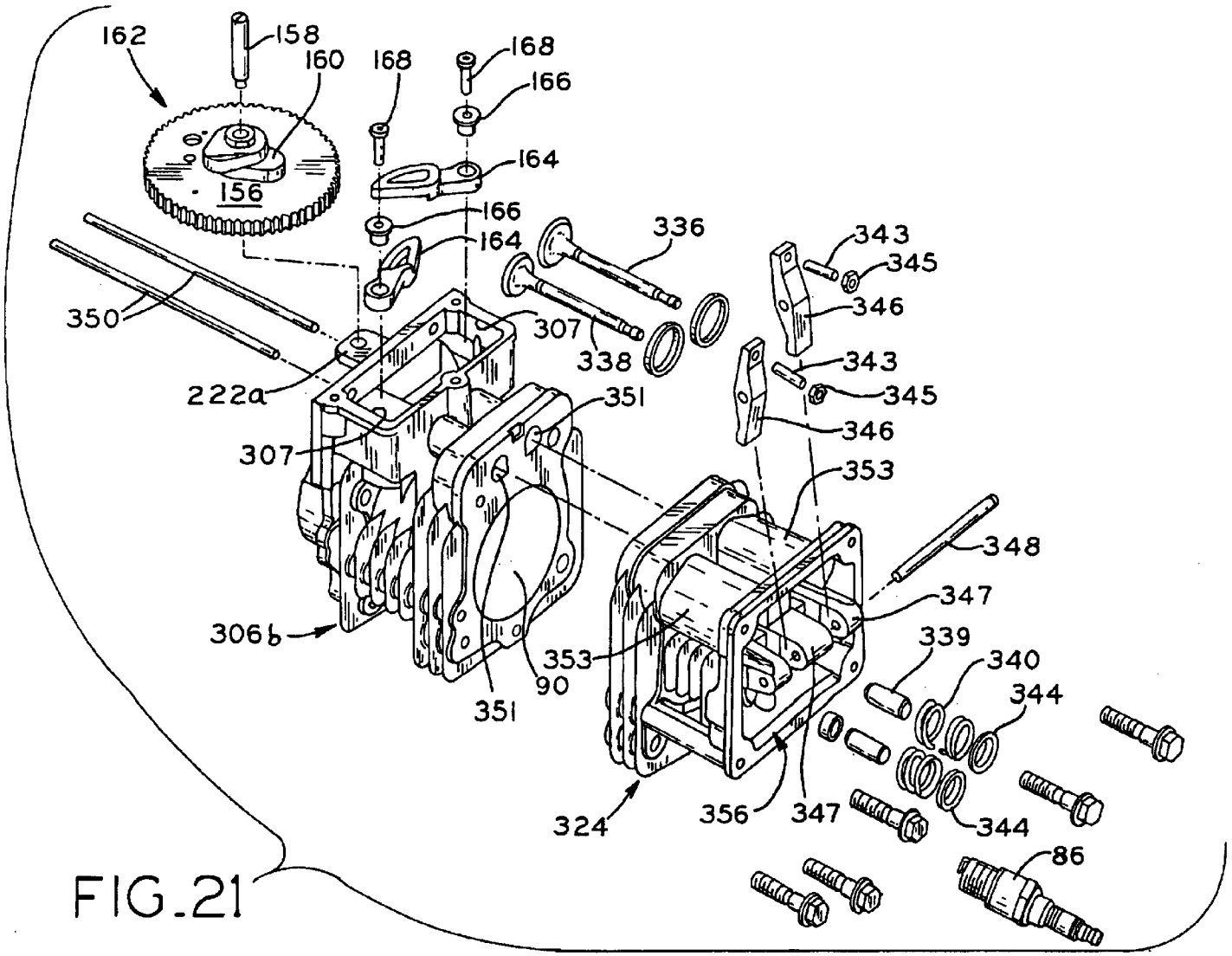
FIG. 21 is an exploded view of a cylinder member and cylinder head assembly of the engine of FIGS. 15–21.
Figure 22:
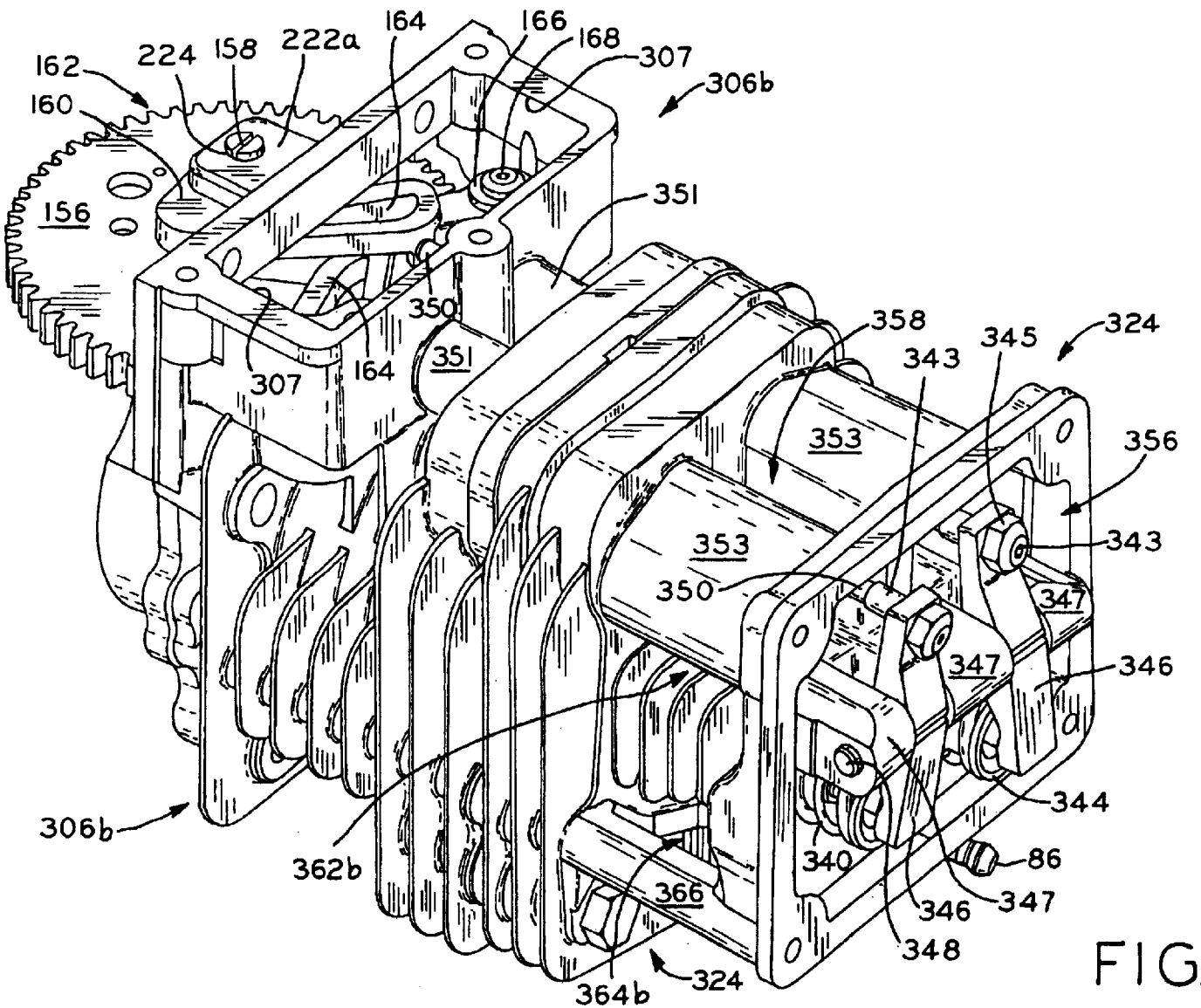
FIG. 22 is a first perspective, assembled view of the cylinder member and cylinder head assembly of FIG. 21.
Figure 23:
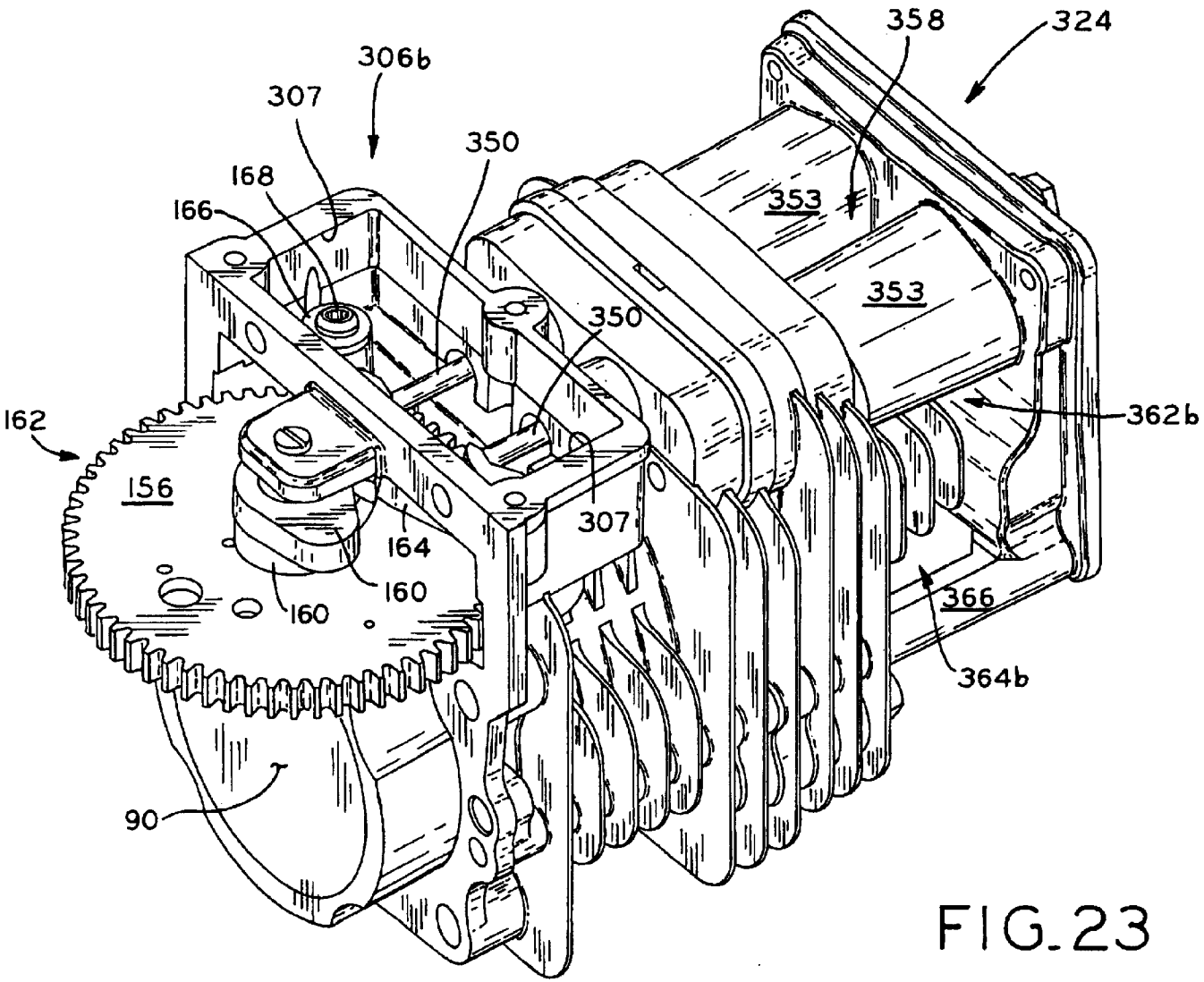
FIG. 23 is a second perspective, assembled view of the cylinder member and cylinder head assembly of FIG. 21.

As shown in FIGS. 21–23, cylinder members 306*a* and 306*b* each include openings 307, similar to openings 108 of cylinder members 74*a* and 74*b*, through which components of valve train 332, such as lifters 164 and off-center adjusters 166, may be accessed. Covers 112*a* and 112*b*, identical to those used with cylinder members 74*a* and 74*b*, may be secured to cylinder members 306*a* and 306*b* to cover openings 307 in the same manner as discussed above with respect to engine 50.

Referring to FIGS. 19 and 20–24, valve train 332 of engine 300 is shown. Valve seats 334 are pressed into cylinder heads 324, or alternatively, may be cast into cylinder heads 324. Intake and exhaust valves 336 and 338 are reciprocatingly carried in valve guides 339 in cylinder heads 324. Valve springs 340 are captured between spring seats 342 (FIGS. 20 and 24) and valve keepers 344 to bias intake and exhaust valves 336 and 338 to a normally closed position, in which the heads of intake and exhaust valves 336 and 338 seat against valve seats 334 to close intake and exhaust ports 328 and 330, respectively, from combustion chamber 190. Rocker arms 346 are pivotally mounted on a rocker arm shaft 348, which is inserted through apertures in support hubs 347 within cylinder head 324, and are operably connected to intake and exhaust valves 336 and 338 and also to push rods 350. Rockers arms 346 further include lash adjustment screws 343 and nuts 345 for adjusting the clearance or "lash" between rocker arms 346 and the ends of push rods 350.

Figure 24:
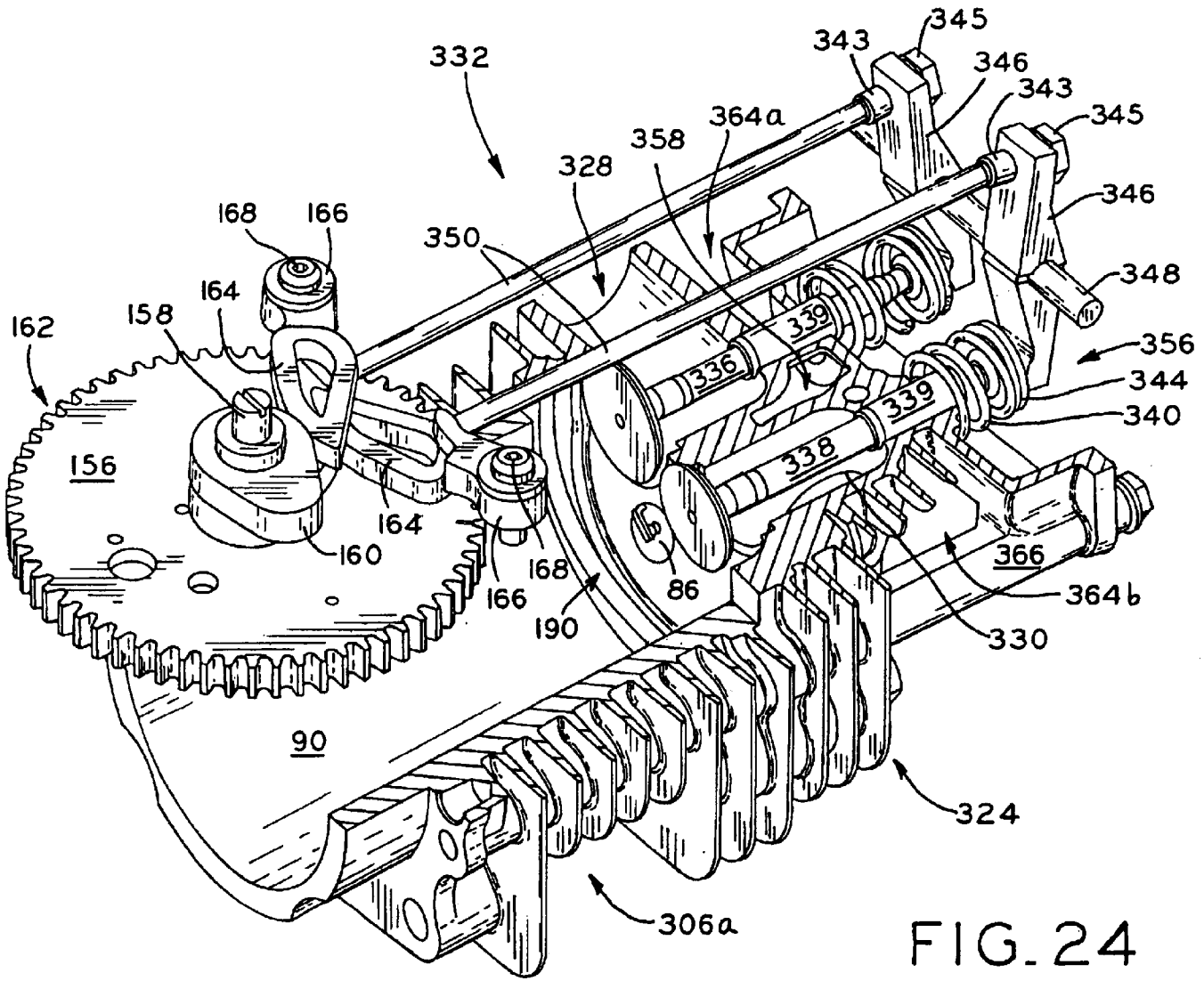
FIG. 24 is a partial sectional view of the cylinder member and cylinder head assembly of FIG. 21.

Push rods 350 extend between lifters 164 and rocker arms 346, and are reciprocatingly carried both within cylinder members 306*a* and 306*b* and cylinder heads 324. As shown in FIGS. 19, 21, and 24, push rods 350 are disposed radially adjacent cylinder bores 190. Referring to FIG. 21, push rods extend through push rod bores 351 in cylinder members 306*a* and 306*b*, and also extend through push rod sleeves 353 of cylinder heads 324. Open outer ends 352 of cylinder heads 324 and cylinder head covers 354 cooperate to define rocker boxes 356, in which rocker arms 346 and other components of valve train 332 are disposed, as shown in FIGS. 19, 21, and 24.

Notably, valve train 332 of engine 300 is identical to valve train 110 of engine 50 from crankshaft 58 to lifters 164. In engine 50, lifters 164 directly engage intake and exhaust valves 174 and 176, such that engine 50 has a side valve, or "L-head" configuration for valve train 110. In engine 300, lifters 164 engage push rods 150 to translate same, which actuates rocker arms 346, which in turn actuates intake and exhaust valves 336 and 338, such that engine 300 has a overhead valve ("OHV") configuration for valve train 332 thereof. Similar to valve train 110 of engine 50, valve train 332 of engine 300 operates on a conventional four-stroke cycle.

Referring to FIGS. 22–24, cylinder head includes a number of passages through which air, directed over the cylinder assemblies by flywheel 78, may flow to cool cylinder heads 324 and rocker boxes 356. A first air passage 358 extends between push rod sleeves 353 as shown in FIGS. 22 and 23, and also between valve guide reinforcement portions 360 of each cylinder head 324, as shown in FIG. 24. Second air passages 362*a* and 362*b* extend respectively between push rod sleeves 353 and intake and exhaust ports 328 and 330. Third air passages 364*a* and 364*b* extend respectively between support struts 366 of each cylinder head 324 and intake and exhaust ports 328 and 330. Airflow through air passages 358, 362*a*, 362*b*, 364*a*, and 364*b* cools cylinder heads 324, particularly exhaust ports 330, as well as rocker boxes 356, during running of engine 300.

Figure 25:
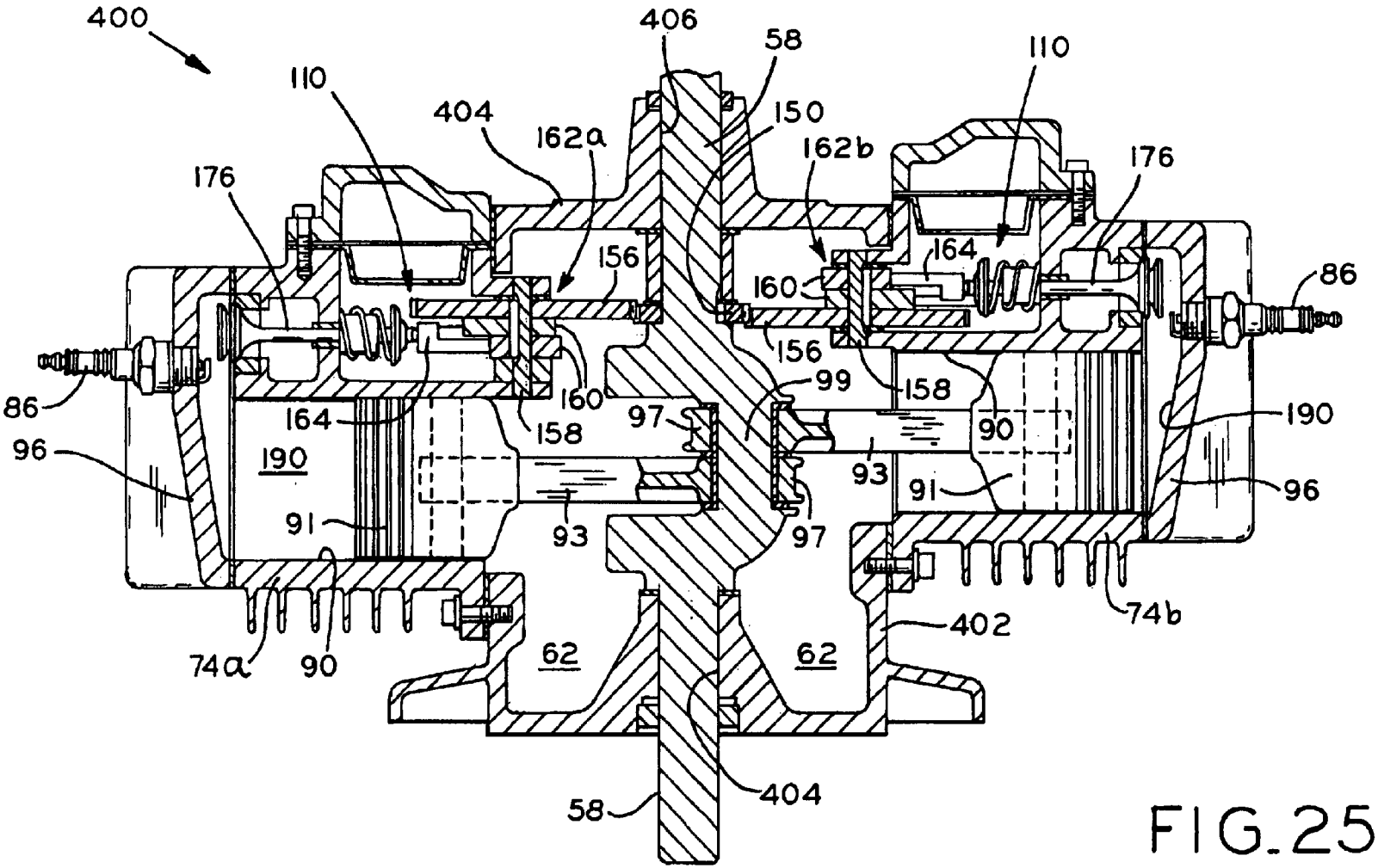
FIG. 25 is a sectional view of a twin cylinder opposed engine including the cylinder members of the engine of FIGS. 1–14.

Referring to FIG. 25, engine 400 is shown, which is a twin cylinder opposed engine including the identical cylinder members 74*a* and 74*b* of engine 50. Cylinder members 74*a* and 74*b* are each attached to opposite walls of crankcase 402 in the same manner as discussed above with respect to engine 50, and are disposed directly opposite one another to provide an opposed arrangement. The components of the cylinder members 74*a* and 74*b*, as well as several other components of engine 400, are identical to those described above with respect to engine 50, and identical reference numerals are used to designate the various components which may be shared therebetween. In this manner, engine 400 includes the identical side valve or "L-head" valve train 110 as engine 50. Crankshaft 58 of engine 400 is disposed vertically; however, engine 400 may alternatively be configured such that crankshaft 58 is disposed horizontally. Crankcase 402 includes first crank bearing 404, and crankcase cover 404 is attached to the open upper end of crankcase 402 to enclose same, and includes second crank bearing 406. Connecting rods 93 are attached to a common crank pin 99 of crankshaft 58, and cylinder members 74*a* and 74*b* are therefore staggered with respect to one another along the length of crankshaft 58.

Figure 26:
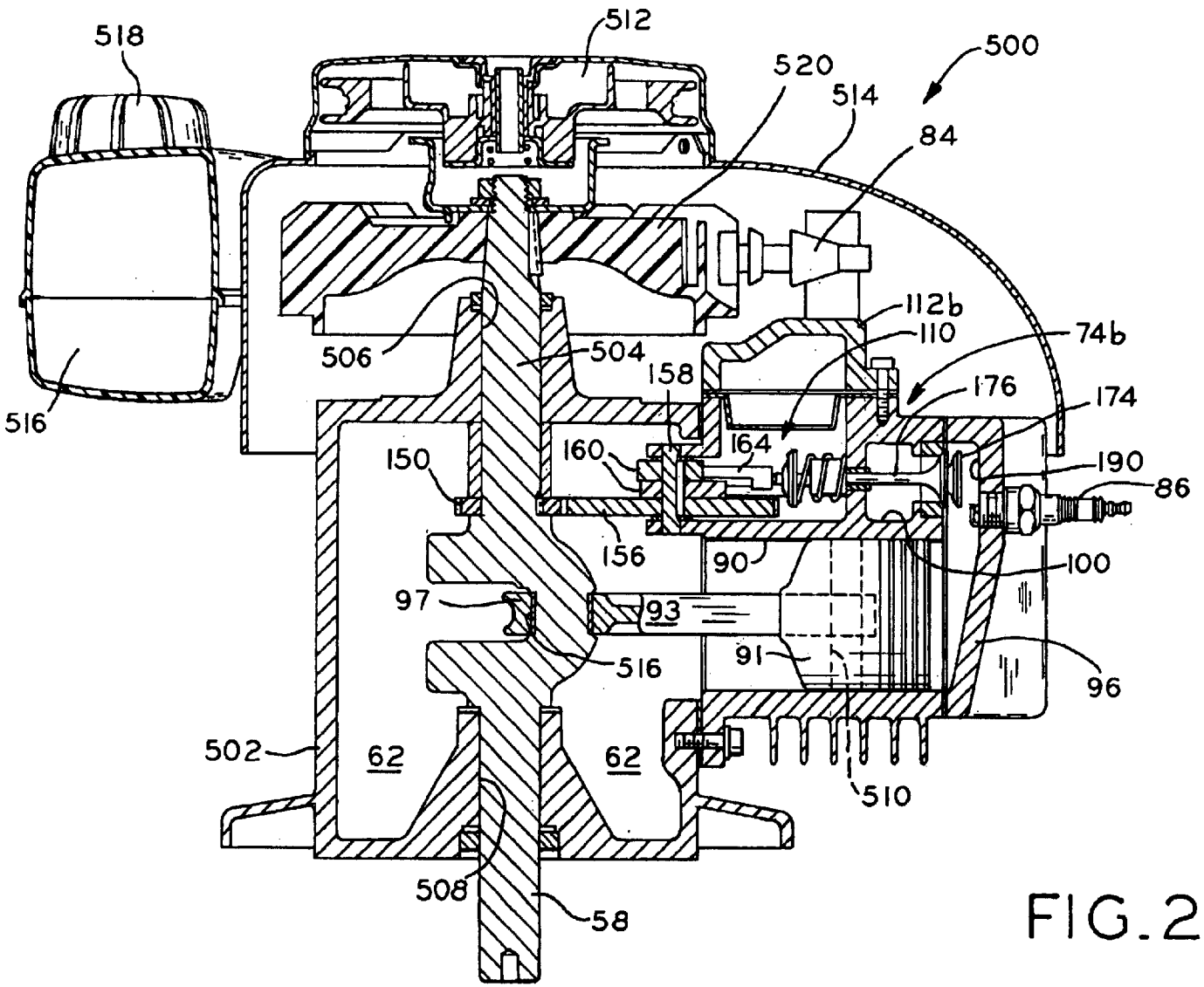
FIG. 26 is a sectional view of a single cylinder, vertical crankshaft engine including a cylinder member of the engine of FIGS. 1–14.

Advantageously, the cylinder members 74*a* or 74*b* of engine 50 may also be used in single cylinder engines without modifications to the cylinder members. For example, as shown in FIG. 26, a cylinder member, such as 74*b*, is shown in a vertical crankshaft, single cylinder engine 500. Engine 500 includes crankcase 502 having a vertically disposed crankshaft 58 journalled in upper crank bearing 506 and lower crank bearing 508. The components of the cylinder member 74*b*, as well as several other components of engine 500, are identical to those described above with respect to engine 50, and identical reference numerals are used to designate the various components which may be shared therebetween. In this manner, engine 500 includes the identical side valve or "L-head" valve train 110 as engine 50. Piston 91 reciprocates within cylinder bore 90, and connecting rod 93 is connected at one end thereof to piston 91 by wrist pin 510, and at an opposite end thereof to crankpin 99 of crankshaft 58 by split cap 97. Engine 500 additionally includes flywheel 78 and a recoil starter mechanism 512, each mounted to an end of crankshaft 58 which extends externally of crankcase 502. Shroud/blower housing 514 covers the upper portion of crankcase 502 and cylinder member 74*b* for directing cooling air from flywheel 78 over crankcase 502 and cylinder member 74*b*. Fuel tank 516 with fuel tank cap 518 are attached to shroud 514 in a suitable manner.

Figure 27:
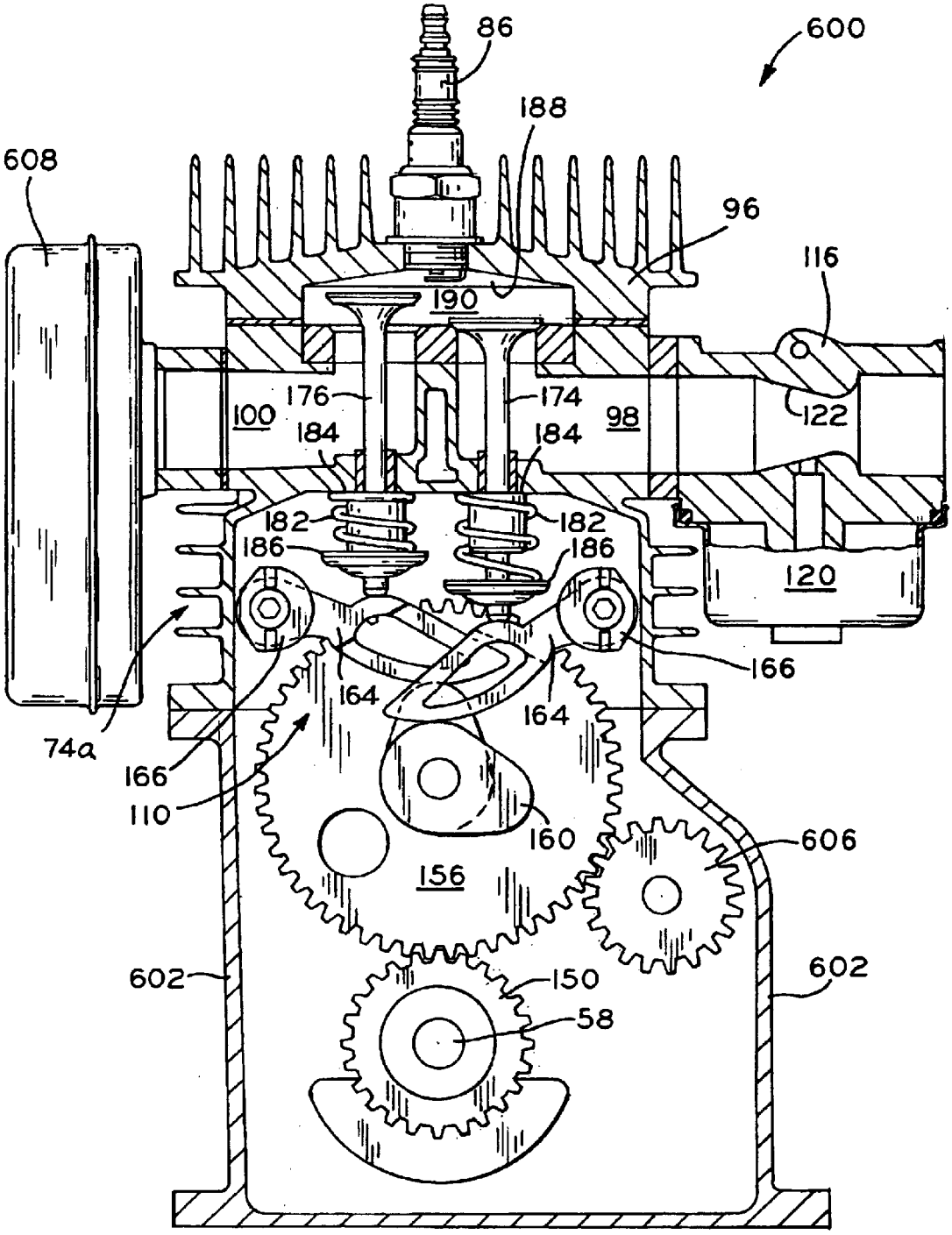
FIG. 27 is a sectional view of a single cylinder, horizontal crankshaft engine including a cylinder member of the engine of FIGS. 1–14, the engine having a vertical profile.

In FIG. 27, cylinder member 74*a* is shown in a horizontal crankshaft, single cylinder engine 600. The components of the cylinder member 74*a*, and several other components of engine 600, are identical to those described above with respect to engine 50, and identical reference numerals are used to designate the various components which may be shared therebetween. In this manner, engine 600 includes the identical side valve or "L-head" valve train 110 as engine 50. Engine 600 includes crankcase 602, which is configured for attachment of cylinder member 74*a* vertically there above such that engine 600 has a vertical overall profile or orientation. Crankcase 602 includes a horizontally disposed crankshaft 58. Drive gear 150 is mounted on crankshaft 58 for engaging cam gear 156, and cam gear 156 also drives auxiliary gear 606 for powering an auxiliary device such as a governor, for example. Additionally, carburetor 116 is mounted to intake port 98 of cylinder member 74*a*, and muffler 608 is mounted to exhaust port 100 of cylinder member 72*a*.

Figure 28:
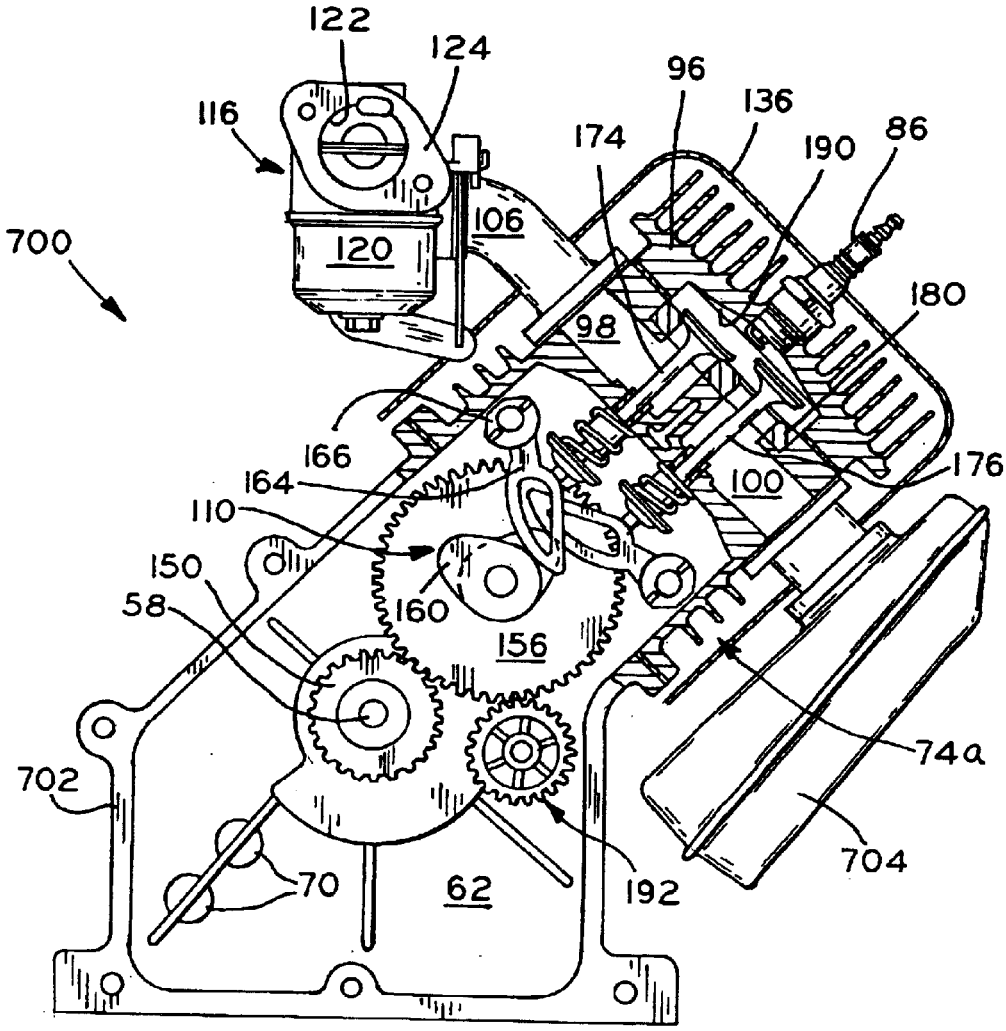
FIG. 28 is a sectional view of a single cylinder, horizontal crankshaft engine including a cylinder member of the engine of FIGS. 1–14, the engine having a slant profile.

In FIG. 28, cylinder member 74*a* is shown in a horizontal crankshaft, single cylinder engine 700. The components of the cylinder member 74*a* and other components of engine 700 are identical to those described above with respect to engine 50, and identical reference numerals are used to designate the various components which may be shared therebetween. In this manner, engine 700 includes the identical side valve or "L-head" valve train 110 as engine 50. Engine 700 includes crankcase 702, which is configured for attachment of cylinder member 74*a* at an angle with respect to crankcase 702, such that engine 700 has an overall slant profile or orientation. Carburetor 116 is mounted to intake port 98 of cylinder member 74*a*, and muffler 704 is mounted to exhaust port 100 of cylinder member 72*a*.

Although engines 400, 500, 600, and 700 are shown above having one or more of cylinder members 74*a* and 74*b* of engine 50 to provide a side valve or "L-head" valve train 110, engines 400, 500, 600, and 700 could alternatively include cylinder members 306*a* and 306*b* of engine 300, together with cylinder heads 324, to provide an ("OHV") valve train 332.

Therefore, the cylinder members 74*a*, 74*b* and 306*a*, 306*b* of the above-described engines 50 and 300 are common, modular components which may be used both in single cylinder and in twin cylinder engines, thereby reducing the number of engine components used for manufacturing single and twin cylinder engines and reducing the costs associated with manufacturing the foregoing engines.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A twin cylinder internal combustion engine, comprising:

a crankcase;

a crankshaft rotatably disposed within said crankcase, said crankshaft having a drive gear mounted thereto;

a pair of cylinder members mounted to said crankcase, said cylinder members and said crankcase being separate components; and a valve train, comprising:

a pair of cam gears respectively rotatably mounted to said cylinder members, said cam gears in meshing engagement with said drive gear;

at least one cam lobe associated with each said cam gear; and at least one lifter pivotally mounted within each said cylinder member, each said lifter in engagement with a respective said cam lobe.

2. The internal combustion engine of claim 1, wherein each said cylinder member includes a pair of said lifters, and each said cam gear includes a pair of said cam lobes, each said cam lobe actuating a respective said lifter.

3. The internal combustion engine of claim 2, wherein each said cylinder member includes an intake valve and an exhaust valve in respective engagement with said lifters.

4. The internal combustion engine of claim 3, wherein each said cylinder member comprises a cylinder bore therein and said intake and exhaust valves are disposed radially adjacent said cylinder bore in each said cylinder member.

5. The internal combustion engine of claim 3, wherein each said cylinder member further comprises a valve seat for each of said intake and exhaust valves.

6. The internal combustion engine of claim 2, wherein each said cylinder member further comprises:

an intake valve in engagement with one of said lifters;

an intake port communicating with said intake valve;

an exhaust valve in engagement with the other of said lifters; and an exhaust port communicating with said exhaust valve.

7. The internal combustion engine of claim 1, further comprising a cylinder head attached to each said cylinder member, each said cylinder member and cylinder head defining a combustion chamber therebetween.

8. The internal combustion engine of claim 1, wherein at least a portion of each said cam gear extends into said crankcase for engagement with said drive gear.

9. The internal combustion engine of claim 2, wherein said valve train further comprises a pair of push rods carried in each said cylinder member, said push rods actuated by respective said lifters.

10. The internal combustion engine of claim 9, wherein each said cylinder member comprises a cylinder bore therein, and said push rods are disposed radially adjacent said cylinder bore in each said cylinder member.

11. The internal combustion engine of claim 9, wherein each said cylinder member further comprises a cylinder head, each said cylinder head comprising:

an intake valve;

an exhaust valve; and a pair of rocker arms for respectively actuating said intake and exhaust valves in response to movement of said push rods.

12. A twin cylinder internal combustion engine, comprising:

a crankcase having a crankshaft rotatably disposed therein a pair of cylinder members mounted to said crankcase, said cylinder members and said crankcase being separate components; and a valve train, comprising:

a pair of cam gears respective rotatably mounted to said cylinder members, at least a portion of each said cam gear extending into said crankcase for driving engagement with said crankshaft;

a pair of cam lobes associated with each said cam gear; and a pair of lifters pivotally mounted to each said cylinder member, each said lifter in engagement with a respective said cam lobe.

13. The internal combustion engine of claim 12, further comprising a drive gear mounted to said crankshaft, said drive gear in meshing engagement with each of said cam gears.

14. The internal combustion engine of claim 12, wherein said valve train further comprises an intake valve and an exhaust valve carried in each said cylinder member, each said intake and exhaust valve actuated by a respective said lifter.

15. The internal combustion engine of claim 14, wherein each said cylinder member comprises a cylinder bore therein, and said intake and exhaust valves are disposed radially adjacent said cylinder bore in each said cylinder member.

16. The internal combustion engine of claim 12, wherein each said cylinder member further comprises a cylinder head, each said cylinder member and cylinder head defining a combustion chamber therebetween.

17. The internal combustion engine of claim 16, wherein said valve train further comprises a pair of push rods carried in each said cylinder member for actuating valves within said cylinder heads, each said push rod actuated by a respective said lifter.

18. A twin cylinder internal combustion engine, comprising:

a crankcase;

a pair of cylinder members mounted to said crankcase, said cylinder members and said crankcase being separate components;

a cam gear and lobe assembly rotatably mounted to each said cylinder member, one of said cam gear and lobe assemblies facing in a first direction, and the other of said cam gear and lobe assemblies facing in a second direction opposite said first direction.

19. The internal combustion engine of claim 18, further comprising:

a crankshaft rotatably disposed within said crankcase; and a drive gear mounted on said crankshaft, said drive gear in driving engagement with each said cam gear and lobe assemblies.

20. The internal combustion engine of claim 18, wherein each said cam gear and cam assembly includes a cam gear and a pair of cam lobes.

21. The internal combustion engine of claim 18, wherein each said cylinder member includes a pair of lifters rotatably mounted thereto, each said cam lobe actuating a respective said lifter.

22. The internal combustion engine of claim 21, further comprising a pair of valves carried in each said cylinder member, each said valve actuated by a respective said lifter.

23. The internal combustion engine of claim 21, further comprising a pair of push rods carried in each said cylinder member, each said push rod actuated by a respective said lifter.

* * * * *

UNITED STATES PATENT AND TRADEMARK OFFICE

CERTIFICATE OF CORRECTION

PATENT NO. : 6,941,914 B2
DATED : September 13, 2005
INVENTOR(S) : Dale D. Snyder et al.

It is certified that error appears in the above-identified patent and that said Letters Patent is hereby corrected as shown below:

Column 16,
Line 27, delete “respective” and insert -- respectively --.

Signed and Sealed this

Twenty-second Day of November, 2005

JON W. DUDAS
*Director of the United States Patent and Trademark Office*